US012171270B2

(12) United States Patent
Bleloch et al.

(10) Patent No.: US 12,171,270 B2
(45) Date of Patent: Dec. 24, 2024

(54) LEAKAGE PREVENTION STRUCTURE IN A VAPORIZER DEVICE

(71) Applicant: Philip Morris Products, S.A., Neuchâtel (CH)

(72) Inventors: Andrew L. Bleloch, Kenmore, WA (US); Peter Nysen, Campbell, CA (US)

(73) Assignee: Philip Morris Products, S.A., Neuchâtel (CH)

( * ) Notice: Subject to any disclaimer, the term of this patent is extended or adjusted under 35 U.S.C. 154(b) by 499 days.

(21) Appl. No.: 17/609,179

(22) PCT Filed: May 7, 2020

(86) PCT No.: PCT/US2020/031846
§ 371 (c)(1),
(2) Date: Nov. 5, 2021

(87) PCT Pub. No.: WO2020/227509
PCT Pub. Date: Nov. 12, 2020

(65) Prior Publication Data

US 2022/0225683 A1 Jul. 21, 2022

Related U.S. Application Data

(60) Provisional application No. 62/844,392, filed on May 7, 2019.

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/465* (2020.01); *A24F 40/51* (2020.01); *A24F 40/57* (2020.01)

(58) Field of Classification Search
CPC ..... A24F 40/10; A24F 40/57; A24F 40/42; A24F 40/51; A24F 40/485; A24F 40/465
(Continued)

(56) References Cited

U.S. PATENT DOCUMENTS 9,510,623 B2 * 12/2016 Tucker ..... H05B 3/16
10,004,263 B2 * 6/2018 Liu ..... H05B 1/0227
(Continued)

FOREIGN PATENT DOCUMENTS

CA 3005654 A1 6/2017
CN 107708453 A 2/2018
(Continued)

OTHER PUBLICATIONS

Taiwanese Office Action issued on Aug. 16, 2023 in Taiwanese Patent Application No. 109115215 (with English translation), 10 pages.

*Primary Examiner* — Abdullah A Riyami
*Assistant Examiner* — Vladimir Imas
(74) *Attorney, Agent, or Firm* — Oblon, McClelland, Maier & Neustadt, L.L.P.

(57) ABSTRACT

Provided is a vaporizer device, including a reservoir configured to contain an aerosolizable substance, the reservoir including a first opening and a second opening, a susceptor element coupled to the reservoir, the susceptor element positioned within the first opening of the reservoir, the susceptor element configured to be in contact with the aerosolizable substance, and a leakage prevention structure configured to transition the reservoir from a sealed state to an unsealed state. When the reservoir is in the unsealed state, the leakage prevention structure may air to flow through the second opening. When the reservoir is in the sealed state, a vacuum may be formed in the reservoir. When the reservoir transitions from the sealed state to the unsealed state, the
(Continued)

vacuum may be released. Methods and computer program products are also provided.

22 Claims, 12 Drawing Sheets

(51) Int. Cl.
*A24F 40/42* (2020.01)
*A24F 40/465* (2020.01)
*A24F 40/51* (2020.01)
*A24F 40/57* (2020.01)

(58) Field of Classification Search
USPC ..... 131/329
See application file for complete search history.

(56) References Cited

U.S. PATENT DOCUMENTS 10,118,013 B2 * 11/2018 Krietzman ..... A24F 40/48
10,123,566 B2 * 11/2018 Tucker ..... H05B 3/0014
10,279,934 B2 * 5/2019 Christensen ..... B65B 3/18
10,292,424 B2 * 5/2019 Brammer ..... F24H 1/0018
10,595,566 B2 * 3/2020 Jiang ..... A24F 40/42
10,729,178 B2 * 8/2020 Reevell ..... H05B 3/0019
10,881,137 B2 * 1/2021 Suzuki ..... A24F 40/48
11,160,306 B2 * 11/2021 Daryani ..... A24F 40/42
11,208,240 B2 * 12/2021 Biel ..... B65D 47/248
11,357,262 B2 * 6/2022 Rogan ..... A24F 40/42
11,388,932 B2 * 7/2022 Courbat ..... A24F 40/465
11,553,730 B2 * 1/2023 Cameron ..... B05B 17/0684
2014/0334803 A1 * 11/2014 Li ..... A61M 15/06 392/394
2015/0208731 A1 * 7/2015 Malamud ..... H05B 1/0244 131/328
2015/0257447 A1 * 9/2015 Sullivan ..... A61M 15/06 131/329
2017/0079322 A1 * 3/2017 Li ..... A24B 15/42
2017/0231278 A1 8/2017 Mironov et al.
2018/0213843 A1 * 8/2018 Mironov ..... A61M 11/042
2018/0255834 A1 * 9/2018 Dillmann ..... A24B 15/167
2019/0230996 A1 * 8/2019 Brammer ..... A61M 15/025
2019/0328039 A1 * 10/2019 Romming ..... A24F 40/485
2021/0401061 A1 * 12/2021 Davis ..... A24F 40/57
2022/0295887 A1 * 9/2022 Rogan ..... A24F 40/48
2023/0068343 A1 * 3/2023 Batista ..... A24F 40/20

FOREIGN PATENT DOCUMENTS

CN 208798693 U 4/2019
GB 2542007 A 3/2017

* cited by examiner

LEAKAGE PREVENTION STRUCTURE IN A VAPORIZER DEVICE

CROSS-REFERENCE TO RELATED APPLICATIONS

This application is the United States national phase of International Application No. PCT/US2020/031846 filed May 7, 2020, and claims priority to U.S. Provisional Application No. 62/844,392 filed May 7, 2019, the disclosure of which is hereby incorporated by reference in its entirety.

BACKGROUND

1. Field

This disclosure relates generally to a vaporizer device and, in some non-limiting embodiments, to a leakage prevention structure for preventing leakage of an aerosolizable substance in a vaporizer device.

2. Technical Considerations

A vaporizer may include an electronic device that simulates tobacco smoking. In some instances, a vaporizer may include a handheld battery-powered vaporizer that produces an aerosol (e.g., a vapor) instead of smoke produced by burning tobacco. A vaporizer may include a heating element that is used to aerosolize (e.g., atomize) an aerosolizable substance (e.g., a substance that produces an aerosol when heating, such as a liquid, a liquid solution, a wax, an herbal material, etc.) to produce the aerosol. In some examples, the liquid solution may be referred to as an e-liquid. The aerosol produced by the vaporizer may include particulate matter. In some instances, the particulate matter may include propylene glycol, glycerin, nicotine, and/or flavoring.

BRIEF DESCRIPTION OF THE DRAWINGS

Additional advantages and details of the disclosure are explained in greater detail below with reference to the exemplary embodiments that are illustrated in the accompanying schematic figures, in which.

DETAILED DESCRIPTION

Figure 1B:
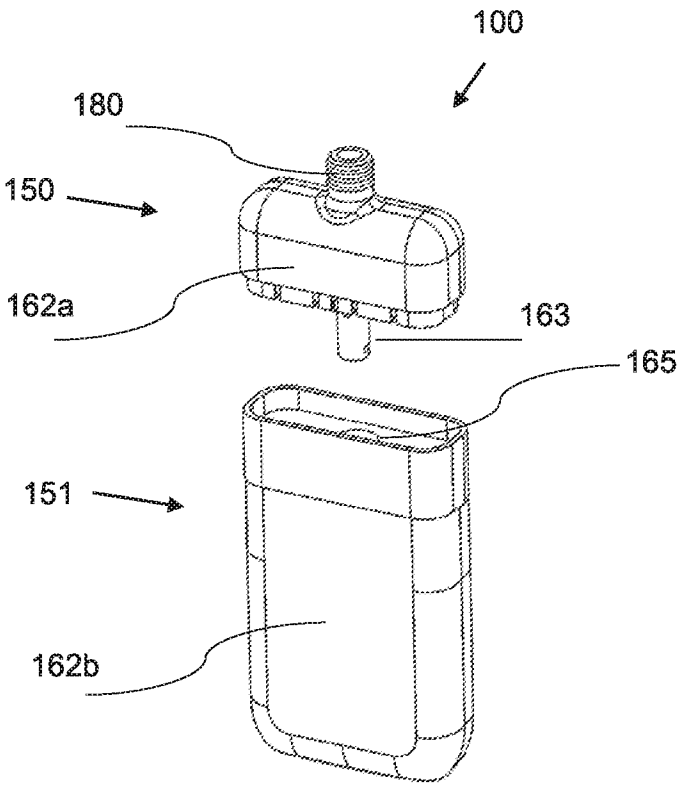
FIGS. 1A and 1B are diagrams of a non-limiting embodiment of the vaporizer device.

The present disclosure relates generally to systems, methods, and products used for preventing leakage in a vaporizer device. Accordingly, various embodiments are disclosed herein of devices, systems, computer program products, apparatus, and/or methods for preventing leakage of an aerosolizable substance within a vaporizer device.

Non-limiting embodiments are set forth in the following numbered clauses:

Clause 1: A vaporizer device comprising: a reservoir configured to contain a vaporizable substance, the reservoir comprising a first opening and a second opening; a susceptor element coupled to the reservoir, the susceptor element positioned within the first opening of the reservoir, the susceptor element configured to be in contact with the vaporizable substance; and a leakage prevention structure configured to transition the reservoir from a sealed state to an unsealed state; wherein, when the reservoir is in the unsealed state, the leakage prevention structure enables air to flow through the second opening; wherein, when the reservoir is in the sealed state, a vacuum is formed in the reservoir, and when the reservoir transitions from the sealed state to the unsealed state, the vacuum is released.

Clause 2: The vaporizer device of clause 1, further comprising: a housing surrounding at least a portion of the reservoir, wherein the housing comprises a channel; and wherein air flowing through the channel of the housing causes the leakage prevention structure to transition to an open position thereby transitioning the reservoir from the sealed state to the unsealed state.

Clause 3: The vaporizer device of clauses 1 or 2, wherein the leakage prevention structure comprises: a valve coupled to the reservoir; and wherein when the reservoir is in the sealed state, the valve is in a closed position and, when in the closed position, the valve prevents the vaporizable substance from being transferred through the first opening of the reservoir; and wherein, when the reservoir is in the unsealed state, the valve is in an open position, and, when in the open position, the valve enables the vaporizable substance to be transferred through the first opening of the reservoir.

Clause 4: The vaporizer device of any of clauses 1-3, wherein the valve comprises a flexible membrane.

Clause 5: The vaporizer device of any of clauses 1-4, wherein the valve comprises a hydrophobic material.

Clause 6: The vaporizer device of any of clauses 1-5, wherein an amount of the vaporizable substance transferred from the reservoir via the susceptor element to an area outside of the reservoir is determined at least in part based on a pressure inside the reservoir, the pressure inside the reservoir associated with the position of the valve coupled to the reservoir.

Clause 7: The vaporizer device of any of clauses 1-6, further comprising: a housing surrounding at least a portion of the reservoir, the housing comprising a third opening and a fourth opening, wherein a channel is defined within the housing that connects the third opening and the fourth opening; and wherein, when an amount of pressure inside the channel satisfies a pressure threshold associated with the unsealed state of the reservoir, the valve is configured to transition from the closed position to the open position based on the amount of pressure inside the channel.

Clause 8: The vaporizer device of any of clauses 1-7, further comprising: a mouthpiece positioned adjacent to the fourth opening; and wherein the valve is configured to transition from the closed position to the open position based on suction that is generated at the mouthpiece.

Clause 9: The vaporizer device of any of clauses 1-8, wherein the channel is a non-linear channel, the non-linear channel comprising an orifice; and wherein the orifice of the non-linear channel is configured to collect the vaporizable substance that is transferred in the channel.

Clause 10: The vaporizer device of any of clauses 1-9, wherein, when the amount of pressure inside the channel satisfies a pressure threshold associated with the sealed state of the reservoir, the valve is configured to transition from the open position to the closed position.

Clause 11: The vaporizer device of any of clauses 1-10, wherein the housing and the at least a portion of the reservoir define the channel that connects the third opening and the fourth opening.

Clause 12: The vaporizer device of any of clauses 1-11, wherein the housing surrounds at least a portion of the valve, and wherein the housing comprises a fifth opening that enables air to flow from an environment outside the housing into the channel of the housing.

Clause 13: The vaporizer device of any of clauses 1-12, further comprising: at least one processor programmed or configured to: control the valve to transition between the open position and the closed position.

Clause 14: The vaporizer device of any of clauses 1-13, further comprising: an actuator coupled to the valve; wherein the at least one processor is further programmed or configured to: control the actuator to transition the valve between the open position and the closed position.

Clause 15: The vaporizer device of any of clauses 1-14, further comprising: a temperature sensor to obtain data associated with a temperature inside the channel of the housing; wherein the at least one processor is further programmed or configured to: control the actuator to transition the value between the open position and the closed position based on the data associated with the temperature measurement of the temperature inside the channel.

Clause 16: The vaporizer device of any of clauses 1-15, further comprising: a temperature sensor to obtain data associated with a temperature inside the channel; and wherein the at least one processor is further programmed or configured to: control the actuator to transition the valve between the open position and the closed position based on data associated with a temperature measurement received from the temperature sensor.

Clause 17: The vaporizer device of any of clauses 1-16, wherein the at least one processor is further programmed or configured to: receive data associated with the temperature inside the channel; determine whether the temperature inside the channel has increased at a predetermined rate; and cause a heating element to generate thermal energy based on determining that the temperature inside the channel has increased at the predetermined rate; wherein, the actuator is configured to transition to an open position based on the heating element generating thermal energy.

Clause 18: The vaporizer device of any of clauses 1-17, wherein the at least one processor is programmed or configured to: determine whether an amount of pressure inside the channel satisfies a pressure threshold associated with the unsealed state of the reservoir; and cause the valve to transition to the open position or to the closed position based on determining whether pressure inside the channel satisfies the pressure threshold associated with the unsealed state of the reservoir.

Clause 19: The vaporizer device of any of clauses 1-18, wherein the at least one processor is programmed or configured to: determine whether a pressure inside the channel satisfies a pressure threshold associated with the sealed state of the reservoir; and cause the valve to transition to the open position or to the closed position based on determining whether pressure inside the channel satisfies the pressure threshold associated with the sealed state of the reservoir.

Clause 20: The vaporizer device of any of clauses 1-19, further comprising: a first pressure sensor to obtain data associated with an amount of pressure inside the channel; a second pressure sensor to obtain data associated with an amount of pressure outside the vaporizer device, and at least one processor programmed or configured to: receive the data associated with an amount of pressure inside the channel from the first pressure sensor; receive the data associated with an amount of pressure outside the vaporizer device from the second pressure sensor; determine a difference between the amount of pressure inside the channel and the amount of pressure outside the vaporizer device; and cause the valve to transition to the open position or the closed position based on the difference between the amount of pressure inside the channel and the amount of pressure outside the vaporizer device.

Clause 21: The vaporizer device of any of clauses 1-20, further comprising: a temperature sensor to obtain data associated with a temperature inside the channel; and at least one processor programmed or configured to: receive the data associated with the temperature inside the channel from the temperature sensor; determine whether a temperature inside the channel has increased at a predetermined rate; cause a heating element to generate thermal energy based on determining that the temperature inside the channel has increased at the predetermined rate; and forego causing a heating element to generate thermal energy based on determining that the temperature inside the channel has not increased at the predetermined rate; and wherein the valve is configured to transition to the closed position based on the heating element foregoing generating thermal energy; and wherein the valve is configured to transition to the closed position based on the heating element generating thermal energy.

Clause 22: The vaporizer device of any of clauses 1-21, wherein the leakage prevention structure comprises: a secondary reservoir configured to receive the vaporizable substance from the susceptor element; and a duct comprising a first end portion, a second end portion, and a channel between the first end portion and the second end portion to allow air to flow within the channel, the first end portion of the duct positioned within the reservoir and the second end portion of the duct positioned within the secondary reservoir; and wherein, when an amount of vaporizable substance included in the secondary reservoir is at a predetermined amount, the reservoir is in the sealed state, and when the amount of vaporizable substance included in the secondary reservoir is not at the predetermined amount, the reservoir is in the unsealed state.

Clause 23: The vaporizer device of any of clauses 1-22, wherein a portion of the duct extends through the second opening of the reservoir, and wherein the channel of the duct comprises the first opening of the reservoir.

Clause 24: The vaporizer device of any of clauses 1-23, wherein a portion of the duct extends through the first opening of the reservoir; and wherein the susceptor element is positioned between the portion of the duct that extends through the first opening of the reservoir and the first opening of the reservoir.

Clause 25: The vaporizer device of any of clauses 1-24, wherein the susceptor element is configured to receive thermal energy, wherein, the thermal energy causes an amount of the vaporizable substance associated with the susceptor element to be vaporized, and wherein, when vaporizing the vaporizable substance, the susceptor element absorbs the vaporizable substance from the secondary reservoir.

Clause 26: The vaporizer device of any of clauses 1-25, wherein the susceptor element is positioned coaxially with regard to the duct, wherein the second end portion of the duct comprises a tapered edge shape, and wherein an end portion of the susceptor element comprises a tapered edge shape that corresponds to the tapered edge shape of the second end portion of the duct.

Clause 27: The vaporizer device of any of clauses 1-26, wherein the susceptor element is positioned coaxially with regard to the duct.

Clause 28: The vaporizer device of any of clauses 1-27, further comprising: at least one processor programmed or configured to: control the susceptor element to generate thermal energy to transition the reservoir between the sealed state and the unsealed state.

Clause 29: A vaporizer device comprising: a reservoir configured to contain an aerosolizable substance, the reservoir comprising a first opening and a second opening; a susceptor element coupled to the reservoir, the susceptor element coupled to the first opening of the reservoir, the susceptor element configured to be in contact with the aerosolizable substance; and a leakage prevention structure configured to transition the reservoir from a sealed state to an unsealed state; wherein, when the reservoir is in the unsealed state, the leakage prevention structure enables air to flow through the second opening; wherein, when the reservoir is in the sealed state, a vacuum is formed in the reservoir, and when the reservoir transitions from the sealed state to the unsealed state, the vacuum is released.

Clause 30: The vaporizer device of clause 29, further comprising: a housing surrounding at least a portion of the reservoir, the housing comprising a third opening and a fourth opening, wherein a channel is defined within the housing that connects the third opening and the fourth opening; and wherein, when an amount of pressure inside the channel is at a pressure threshold associated with the unsealed state of the reservoir, the leakage prevention structure is configured to transition from the closed position to the open position based on the amount of pressure inside the channel; wherein, when the amount of pressure inside the channel is at a pressure threshold associated with the sealed state of the reservoir, the leakage prevention structure is configured to transition from the open position to the closed position.

Clause 31: The vaporizer device of clauses 29 or 30, further comprising: a housing surrounding at least a portion of the reservoir, the housing comprising a third opening and a fourth opening, wherein a channel is defined within the housing that connects the third opening and the fourth opening; and wherein, when an amount of pressure inside the channel is at a pressure threshold associated with the unsealed state of the reservoir, the valve is configured to transition from the closed position to the open position based on the amount of pressure inside the channel.

Clause 32: The vaporizer device of any of clauses 29-31, wherein the channel is a non-linear channel, the non-linear channel comprising an orifice; and wherein the orifice of the non-linear channel is configured to collect the aerosolizable substance that is transferred in the channel.

Clause 33: A vaporizer device comprising: a reservoir configured to contain an aerosolizable substance, the reservoir comprising a first opening and a second opening; a susceptor element coupled to the reservoir, the susceptor element coupled to the first opening of the reservoir, the susceptor element configured to be in contact with the aerosolizable substance; and a valve configured to transition the reservoir from a sealed state to an unsealed state; wherein, when the reservoir is in the unsealed state, the valve enables air to flow through the second opening; wherein, when the reservoir is in the sealed state, a vacuum is formed in the reservoir, and when the reservoir transitions from the sealed state to the unsealed state, the vacuum is released.

Clause 34: The vaporizer device of clause 33, further comprising: a housing surrounding at least a portion of the reservoir, the housing comprising a third opening and a fourth opening, wherein a channel is defined within the housing that connects the third opening and the fourth opening; and wherein, when an amount of pressure inside the channel is at a pressure threshold associated with the unsealed state of the reservoir, the valve is configured to transition from the closed position to the open position based on the amount of pressure inside the channel.

Clause 35: The vaporizer device of clause 33 or 34, wherein, when the amount of pressure inside the channel is at a pressure threshold associated with the sealed state of the reservoir, the valve is configured to transition from the open position to the closed position.

Clause 36: The vaporizer device of any of clauses 33-35, wherein the channel is a non-linear channel, the non-linear channel comprising an orifice; and wherein the orifice of the non-linear channel is configured to collect the aerosolizable substance that is transferred in the channel.

Clause 37: The vaporizer device of any of clauses 33-36, wherein the valve comprises a flexible membrane.

Clause 38: The vaporizer device of any of clauses 33-37, wherein the valve comprises a hydrophobic material.

Clause 39: The vaporizer device of any of clauses 33-38, further comprising: at least one processor programmed or configured to: control the valve to transition between the open position and the closed position.

Clause 40: The vaporizer device of any of clauses 33-39, further comprising: an actuator coupled to the valve; wherein the at least one processor programmed or configured to: control the actuator to transition the valve between the open position and the closed position.

Clause 41: A vaporizer device comprising: a reservoir configured to contain an aerosolizable substance, the reservoir comprising a first opening and a second opening; a susceptor element coupled to the reservoir, the susceptor element coupled to the first opening of the reservoir, the susceptor element configured to be in contact with the aerosolizable substance; a secondary reservoir configured to receive the aerosolizable substance from the susceptor element; and a duct comprising a first end portion, a second end portion, and a channel between the first end portion and the second end portion to allow air to flow within the duct, the first end portion of the duct coupled to the first opening of the reservoir and the second end portion of the duct coupled to the secondary reservoir, wherein the duct is configured to transition the reservoir from a sealed state to an unsealed state; and wherein, when the reservoir is in the unsealed state, the duct enables air to flow through the second opening of the reservoir; wherein, when the reservoir is in the sealed state, the duct enables a vacuum to formed in the reservoir, and when the reservoir transitions from the sealed state to the unsealed state, the vacuum is released; and wherein, when an amount of aerosolizable substance included in the secondary reservoir is at a predetermined amount, the reservoir is in the sealed state, and when the amount of aerosolizable substance included in the secondary reservoir is not at the predetermined amount, the reservoir is in the unsealed state.

Clause 42: The vaporizer device of clause 41, wherein the susceptor element is configured to generate thermal energy, wherein, the thermal energy causes an amount of the aerosolizable substance associated with the susceptor element to be aerosolized, and wherein, when aerosolizing the aerosolizable substance, the susceptor element absorbs the aerosolizable substance from the secondary reservoir.

Clause 43: The vaporizer device of any of clauses 41 or 42, further comprising: at least one processor programmed or configured to: control the susceptor element to generate thermal energy to transition the reservoir between the sealed state and the unsealed state.

Clause 44: The vaporizer device of any of clauses 41-43, wherein the susceptor element is positioned coaxially with regard to the duct, wherein the second end portion of the duct comprises a tapered edge shape, and wherein an end portion of the susceptor element comprises a tapered edge shape that corresponds to the tapered edge shape of the second end portion of the duct.

For purposes of the description hereinafter, the terms "end," "upper," "lower," "right," "left," "vertical," "horizontal," "top," "bottom," "lateral," "longitudinal," and derivatives thereof shall relate to the disclosure as it is oriented in the drawing figures. However, it is to be understood that the disclosure may assume various alternative variations and step sequences, except where expressly specified to the contrary. It is also to be understood that the specific devices and processes illustrated in the attached drawings, and described in the following specification, are simply exemplary embodiments or aspects of the disclosure. Hence, specific dimensions and other physical characteristics related to the embodiments or aspects of the embodiments disclosed herein are not to be considered as limiting unless otherwise indicated.

No aspect, component, element, structure, act, step, function, instruction, and/or the like used herein should be construed as critical or essential unless explicitly described as such. Also, as used herein, the articles "a" and "an" are intended to include one or more items and may be used interchangeably with "one or more" and "at least one." Furthermore, as used herein, the term "set" is intended to include one or more items (e.g., related items, unrelated items, a combination of related and unrelated items, etc.) and may be used interchangeably with "one or more" or "at least one." Where only one item is intended, the term "one" or similar language is used. Also, as used herein, the terms "has," "have," "having," or the like are intended to be open-ended terms. Further, the phrase "based on" is intended to mean "based at least partially on" and "based at least in part on" unless explicitly stated otherwise.

In some non-limiting embodiments, a vaporizer device may include a reservoir configured to contain an aerosolizable substance, the reservoir comprising a first opening and a second opening; a susceptor element coupled to the reservoir, the susceptor element positioned within the first opening of the reservoir, the susceptor element configured to be in contact with the aerosolizable substance; and a leakage prevention structure configured to transition the reservoir from a sealed state to an unsealed state. When the reservoir is in the unsealed state, the leakage prevention structure enables air to flow through the second opening. When the reservoir is in the sealed state, a vacuum is formed in the reservoir, and when the reservoir transitions from the sealed state to the unsealed state, the vacuum is released.

In some non-limiting embodiments, a user may use a vaporizer device to heat an aerosolizable substance to produce an aerosol for inhalation. For example, the user may use the vaporizer device to heat the aerosolizable substance, and the heat may cause the aerosolizable substance to transition to an aerosol. The user may then draw in air from the vaporizer device (e.g., by breathing in on the mouthpiece of the vaporizer device) and inhale the aerosol.

However, the vaporizer device may not include a mechanism to prevent leakage of the aerosolizable substance from within the vaporizer device. For example, the aerosolizable substance may be a liquid that is able to flow out (e.g., leak) from a container, such as a reservoir within the vaporizer device (e.g., in which the liquid is stored) into one or more compartments of the vaporizer device. In this way, leakage of the aerosolizable substance may cause damage to and/or a malfunction of the vaporizer device. In some examples, the vaporizer device may include a cap (e.g., a lid) that encloses an opening of the container. However, the cap may have to be removed each time before the vaporizer device is to be used. In addition, the user may find it highly undesirable for any portion of the aerosolizable substance (e.g., in a non-aerosolized form) to be inhaled or ingested.

In some non-limiting embodiments, the vaporizer device may include a filter, such as a mesh screen, that covers an opening of the container that holds the aerosolizable substance. If the aerosolizable substance is of a specific form that will not move through the filter, such as an herbal material, ingestion of the aerosolizable substance may be prevented. However, for other forms of aerosolizable substances that may move through the filter, such as liquids and/or waxes, use of the vaporizer device with or without the filter may result in the user ingesting the aerosolizable substance.

As described herein, a vaporizer device may include a reservoir configured to contain an aerosolizable substance, the reservoir comprising a first opening and a second opening, a susceptor element coupled to the reservoir, the susceptor element positioned within the first opening of the reservoir, the susceptor element configured to be in contact with the aerosolizable substance, and a leakage prevention structure configured to transition the reservoir from a sealed state to an unsealed state. In some non-limiting embodiments, when the reservoir is in the unsealed state, the leakage prevention structure enables air to flow through the second opening, when the reservoir is in the sealed state, a vacuum is formed in the reservoir, and when the reservoir transitions from the sealed state to the unsealed state, the vacuum is released. In some non-limiting embodiments, the leakage prevention structure includes a valve coupled to the reservoir. When the reservoir is in the sealed state, the valve is in a closed position and, when in the closed position, the valve prevents the aerosolizable substance from being transferred through the first opening of the reservoir. Additionally, when the reservoir is in the unsealed state, the valve is in an open position and, when in the open position, the valve enables the aerosolizable substance to be transferred through the first opening of the reservoir. In some non-limiting embodiments, the leakage prevention structure includes a secondary reservoir configured to receive the aerosolizable substance from the susceptor element and a duct comprising a first end portion, a second end portion, and a channel between the first end portion and the second end portion to allow air to flow within the channel, where the first end portion of the duct is positioned within the reservoir and the second end portion of the duct is positioned within the secondary reservoir. When an amount of aerosolizable substance included in the secondary reservoir is at a predetermined amount, the reservoir is in the sealed state. Additionally, when the amount of aerosolizable substance included in the secondary reservoir is not at the predetermined amount, the reservoir is in the unsealed state.

In this way, the leakage prevention structure may prevent any portion of the aerosolizable substance from being inhaled or ingested by a user. In addition, the leakage prevention structure may prevent damage to and/or a malfunction of the vaporizer device without requiring the use of a cap that can impede a user's enjoyment of the vaporizer device.

Figure 1A:
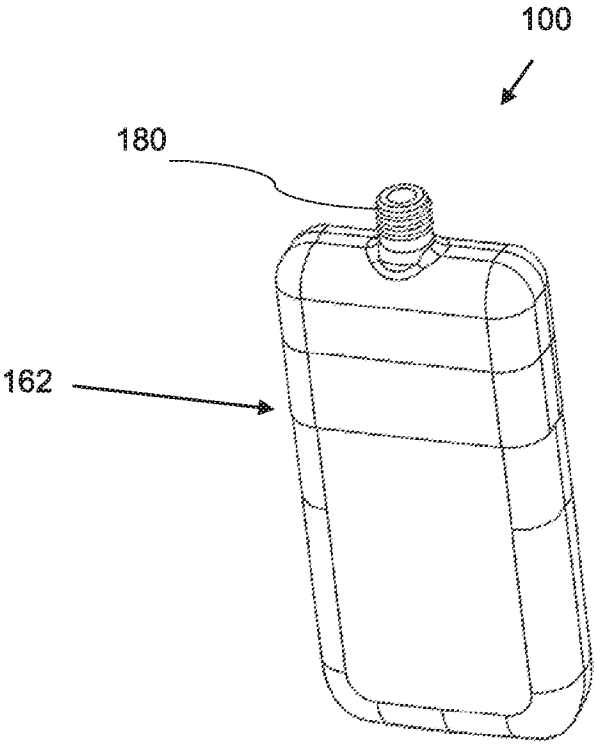

FIGS. 1A and 1B are diagrams of a non-limiting embodiment of vaporizer device 100. As shown in FIGS. 1A and 1B, vaporizer device 100 includes first portion 150 and second portion 151. As shown in FIGS. 1A and 1B, first portion 150 and second portion 151 of vaporizer device 100 are coupled together via an interference fit. As shown in FIG. 1B, first portion 150 and second portion 151 are disassembled. As further shown in FIGS. 1A and 1B, vaporizer device 100 may include housing 162. In some non-limiting embodiments, housing 162 may include first housing section 162*a* and second housing section 162*b*. In some non-limiting embodiments, first portion 150 of vaporizer device 100 may include first housing section 162*a*. In some non-limiting embodiments, second portion 151 of vaporizer device 100 may include second housing section 162*b*. In some non-limiting embodiments, vaporizer device 100 may include mouthpiece component 180. For example, vaporizer device 100 may include mouthpiece component 180 extending from first portion 150 of vaporizer device 100. In some non-limiting embodiments, first portion 150 may include neck portion 163 and second portion 151 may include aperture 165. Neck portion 163 may be sized and configured to fit into aperture 165 to provide for correct alignment for components of vaporizer device 100. Other details regarding a vaporizer device are disclosed in International Patent Application No. PCT/US2020/030477, entitled "System, Method, and Computer Program Product for Determining a Characteristic of a Susceptor" and filed on Apr. 29, 2020, which is incorporated herein by reference.

Figure 2:
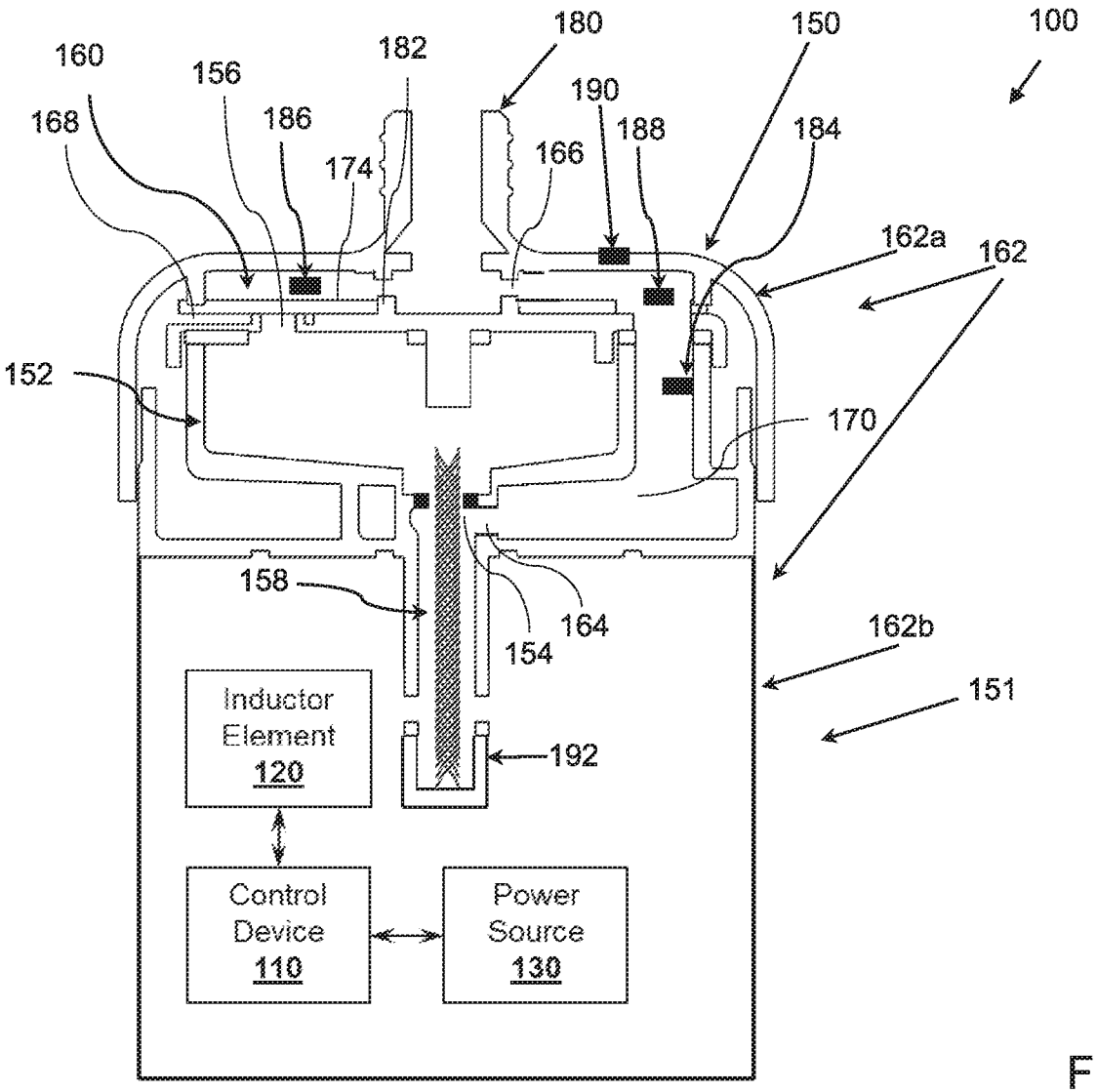
FIG. 2 is a schematic diagram of a non-limiting embodiment of the vaporizer device shown in FIGS. 1A and 1B.

FIG. 2 is a diagram of vaporizer device 100 shown in FIGS. 1A and 1B. It is noted that all components of vaporizer device 100 shown in FIG. 2 are not required in each and every embodiment but the components of vaporizer device 100 are shown in FIG. 2 for purposes of complete illustration. As shown in FIG. 2, first portion 150 and second portion 151 are coupled together via an interference fit. As further shown in FIG. 2, second portion 151 of vaporizer device 100 may include control device 110, inductor element 120, and/or power source 130. In some non-limiting embodiments, control device 110, inductor element 120, and/or power source 130 may be included in first portion 150 of vaporizer device 100 as appropriate.

In some non-limiting embodiments, control device 110 may include one or more devices capable of controlling power source 130 to provide power to one or more components (e.g., inductor element 120) of a vaporizer device (e.g., vaporizer device 100, vaporizer device 400, vaporizer device 500). In one example, control device 110 is configured to control an amount of heat provided by a susceptor element (e.g., susceptor element 158) to an aerosolizable substance in contact with susceptor element 158 based on a magnetic field associated with inductor element 120 (e.g., a magnetic field produced by inductor element 120). In some non-limiting embodiments, control device 110 includes a computing device, such as a computer, a processor, a microprocessor, a controller, and/or the like. In some non-limiting embodiments, control device 110 includes one or more electrical circuits that provide power conditioning for power provided by power source 130.

In some non-limiting embodiments, inductor element 120 may include one or more electrical components and/or one or more devices capable of providing electromagnetic energy to susceptor element 158 and/or receiving electromagnetic energy from susceptor element 158. For example, inductor element 120 may include an induction coil, such as a planar or pancake inductor, or a spiral inductor. In some non-limiting embodiments, inductor element 120 is configured to provide electromagnetic energy (e.g., in the form of a magnetic field, such as a magnetic induction field, in the form of electromagnetic radiation, etc.) to a susceptor element to cause the susceptor element 158 to generate heat based on receiving the electromagnetic energy. In some non-limiting embodiments, inductor element 120 has a size and configuration (e.g., a design) based on the application for which inductor element 120 is applied. In some non-limiting embodiments, inductor element 120 has a length in the range between 4 mm to 20 mm. In one example, inductor element 120 has a length of about 8 mm. In some non-limiting embodiments, inductor element 120 has a width (e.g., a diameter) in the range between 2 mm to 20 mm. In one example, inductor element 120 has a width of about 7 mm. In one example, inductor element 120 includes an induction coil that has 12 turns of 22 gauge wire in 2 layers with an inside diameter of about 6 mm. In some non-limiting embodiments, inductor element 120 has an inductance value in the range between 0.5 μH to 6 μH. In one example, inductor element 120 has an inductance value of about 0.9 μH.

In some non-limiting embodiments, power source 130 includes one or more devices capable of providing power to inductor element 120 and/or control device 110. For example, power source 130 includes an alternating electrical current (AC) power supply (e.g., a generator, an alternator, etc.) and/or a direct current (DC) power supply (e.g., a battery, a capacitor, a fuel cell, etc.). In some non-limiting embodiments, power source 130 is configured to provide power to one or more other components of vaporizer device 100. In some non-limiting embodiments, power source 130 includes one or more electrical circuits that provide power conditioning for power provided by power source 130.

As further shown in FIG. 2, first portion 150 of vaporizer device 100 may include reservoir 152, susceptor element 158, leakage prevention structure 160, housing 162, valve 174, mouthpiece component 180, actuator 182, temperature sensor 184, heating element 186, pressure sensor 188, and/or pressure sensor 190. In some non-limiting embodiments, reservoir 152, susceptor element 158, leakage prevention structure 160, housing 162, valve 174, mouthpiece component 180, actuator 182, temperature sensor 184, heating element 186, pressure sensor 188, and/or pressure sensor 190 may be included in second portion 151 of vaporizer device 100 as appropriate.

In some non-limiting embodiments, first housing section 162*a* may surround (e.g., entirely surround, partially surround, surround at least a portion of, etc.) the components of vaporizer device 100 included in first portion 150. In some non-limiting embodiments, second portion 151 of vaporizer device 100 may include control device 110, inductor element 120, and/or power source 130 that are surrounded by second housing section 162*b*.

In some non-limiting embodiments, reservoir 152 may be configured to hold an aerosolizable substance (e.g., aerosolizable substance 178 shown in FIG. 3). In some non-limiting embodiments, reservoir 152 may include first opening 154 and second opening 156. For example, reservoir 152 may include first opening 154 that is configured to couple to at least a portion of susceptor element 158. In some non-limiting embodiments, susceptor element 158 may be configured to transfer at least a portion of an aerosolizable substance from reservoir 152 through first opening 154 via a capillary action of susceptor element 158. In some non-limiting embodiments, valve 174 may be coupled to (e.g., attached to reservoir 152) to cover second opening 156.

In some non-limiting embodiments, valve 174 may be configured to control the flow of air (e.g., airflow) into and/or out of reservoir 152. In some non-limiting embodiments, reservoir 152 may be configured to hold an aerosolizable substance that is a liquid (e.g., a viscous substance). In some non-limiting embodiments, secondary reservoir 192 may be positioned opposite first opening of reservoir 152. For example, secondary reservoir 192 may be positioned opposite first opening 154 of reservoir 152. In some non-limiting embodiments, secondary reservoir 192 may include susceptor element 158 (e.g., at least a portion of susceptor element 158) positioned in secondary reservoir 192. In some non-limiting embodiments, housing 162 and secondary reservoir 192 may define one or more additional openings that enable air to flow along susceptor element 158. For example, housing 162 and secondary reservoir 192 may define one or more additional openings that enables air to flow along susceptor element 158 and then through third opening 164 of housing 162.

In some non-limiting embodiments, susceptor element 158 may be constructed of a combination of materials and configured to be in contact with an aerosolizable substance to achieve an appropriate effect. For example, susceptor element 158 may be an interwoven cloth (or otherwise intimately mixed combination) of fine induction heating wires, strands, and/or threads with wicking wires, strands, and/or threads. Additionally or alternatively, susceptor element 158 may include materials that are combined in the form of a rope or foam, or suitably deployed thin sheets of material. In some non-limiting embodiments, susceptor element 158 may include rolled up alternating foils of material. Additionally or alternatively, susceptor element 158 may be surrounded (e.g., partially, completely, etc.) by inductor element 120, which may not necessarily be in contact with susceptor element 158. In some non-limiting embodiments, as susceptor element 158 may include a mesh wick, the mesh wick may be constructed of a material that is efficiently heated by induction (e.g., a FeCrAl alloy or ferritic stainless steel alloy). In some non-limiting embodiments, the mesh wick may be formed using a Kanthal mesh. Additionally or alternatively, susceptor element 158 may be removable from first portion 150 of vaporizer device 100 so that susceptor element 158 may be able to be cleaned, reused, and/or replaced separate from first portion 150 of vaporizer device 100.

In some non-limiting embodiments, leakage prevention structure 160 may include one or more components that prevent an aerosolizable substance from flowing out of (e.g., leaking, leaving, etc.) reservoir 152 of vaporizer device 100 in a non-aerosolized form and moving into other areas of vaporizer device 100. For example, leakage prevention structure 160 may include valve 174. In some non-limiting embodiments, leakage prevention structure 160 may include valve 174 and a device to cause valve 174 to transition reservoir 152 from a sealed state to an unsealed state. For example, leakage prevention structure 160 may include valve 174 and actuator 182. In some non-limiting embodiments, leakage prevention structure 160 may include valve 174 and/or other components (e.g., actuator 182, temperature sensor 184, heating element 186, pressure sensor 188, and/or pressure sensor 190) of vaporizer device 100 that function with control device 110 (e.g., provide data associated with a measurement of a sensor to control device 110, receive a control signal from control device 110, perform an operation based on a control signal from control device 110, etc.) to operate with valve 174 to prevent the aerosolizable substance from flowing out of reservoir 152 of vaporizer device 100 in a non-aerosolized form. In some non-limiting embodiments, leakage prevention structure 160 may include valve 174, where valve 174 is coupled to reservoir 152 (e.g., at least a portion of reservoir 152). In some non-limiting embodiments, valve 174 may include a flexible membrane. For example, valve 174 may include or may be constructed from a suitable grade of silicone rubber. In some non-limiting embodiments, valve 174 may include a hydrophobic material. For example, valve 174 may be coated with a hydrophobic material.

In some non-limiting embodiments, leakage prevention structure 160 may be configured to transition reservoir 152 between a sealed state to an unsealed state. For example, valve 174 may be coupled to reservoir 152 and when the reservoir 152 is in the sealed state, valve 174 is in a closed position. When in the closed position, valve 174 may prevent the aerosolizable substance from being transferred through opening 154 of reservoir 152. When reservoir 152 is in the unsealed state, valve 174 is in an open position. When in the open position, valve 174 enables the aerosolizable substance to be transferred through opening 154 of reservoir 152. In some non-limiting embodiments, when leakage prevention structure 160 transitions reservoir 152 from the sealed state to the unsealed state, a vacuum in reservoir 152 may be released and a flow of air through second opening 156 of reservoir 152 may be enabled. In some non-limiting embodiments, when leakage prevention structure 160 transitions reservoir 152 from the unsealed state to the sealed state, the vacuum may be formed in reservoir 152, and the flow of air through second opening 156 of reservoir 152 may be disabled.

In some non-limiting embodiments, housing 162 (e.g., first housing section 162*a* and/or second housing section 162*b*) may be replaceable to allow a user to customize a particular appearance of vaporizer device 100. In some non-limiting embodiments, housing 162 may surround reservoir 152 (e.g., at least a portion of reservoir 152). In some non-limiting embodiments, housing 162 may include channel 170. In some non-limiting embodiments, air that flows through channel 170 of housing 162 may cause leakage prevention structure 160 (e.g., valve 174 of leakage prevention structure 160) to transition to an open position, thereby transitioning reservoir 152 from the sealed state to the unsealed state.

In some non-limiting embodiments, housing 162 may include fifth opening 168. For example, housing 162 may include fifth opening 168 that enables air to flow from an environment outside housing 162 into channel 170. In some non-limiting embodiments, fifth opening 168 enables air to flow from an environment outside housing 162 into reservoir 152.

In some non-limiting embodiments, housing 162 may be constructed from any suitable material such as wood, metal, fiberglass, plastic, and/or the like. In some non-limiting embodiments, housing 162 may include mouthpiece component 180. For example, housing 162 may include mouthpiece component 180, where mouthpiece component 180 is interchangeable. In such an example, variants of mouthpiece component 180 may be designed such that mouthpiece component 180 may restrict airflow to reproduce the pulling sensation (e.g., similar to the sensation users may prefer and/or be familiar with in respect to smoking cigarettes, cigars, pipes, etc.). In some non-limiting embodiments, mouthpiece component 180 may be associated with (e.g., coupled to, integrally formed with, etc.) first housing section 162*a* of vaporizer device 100. For example, mouthpiece component 180 may be associated with first housing section 162*a* of vaporizer device 100 and mouthpiece component 180 may be configured to enable air to flow from fourth opening 166 of housing 162 to an area outside of vaporizer device 100. In some non-limiting embodiments, mouthpiece component 180 may be positioned adjacent to fourth opening 166 of housing 162.

In some non-limiting embodiments, channel 170 may extend through first portion 150 and/or second portion 151 of housing 162. In some non-limiting embodiments, channel 170 may extend between third opening 164 and fourth opening 166 of housing 162 to enable airflow through channel 170 between third opening 164 and fourth opening 166 of housing 162. Channel 170 may be defined within housing 162 that connects third opening 164 and fourth opening 166.

Figure 4:
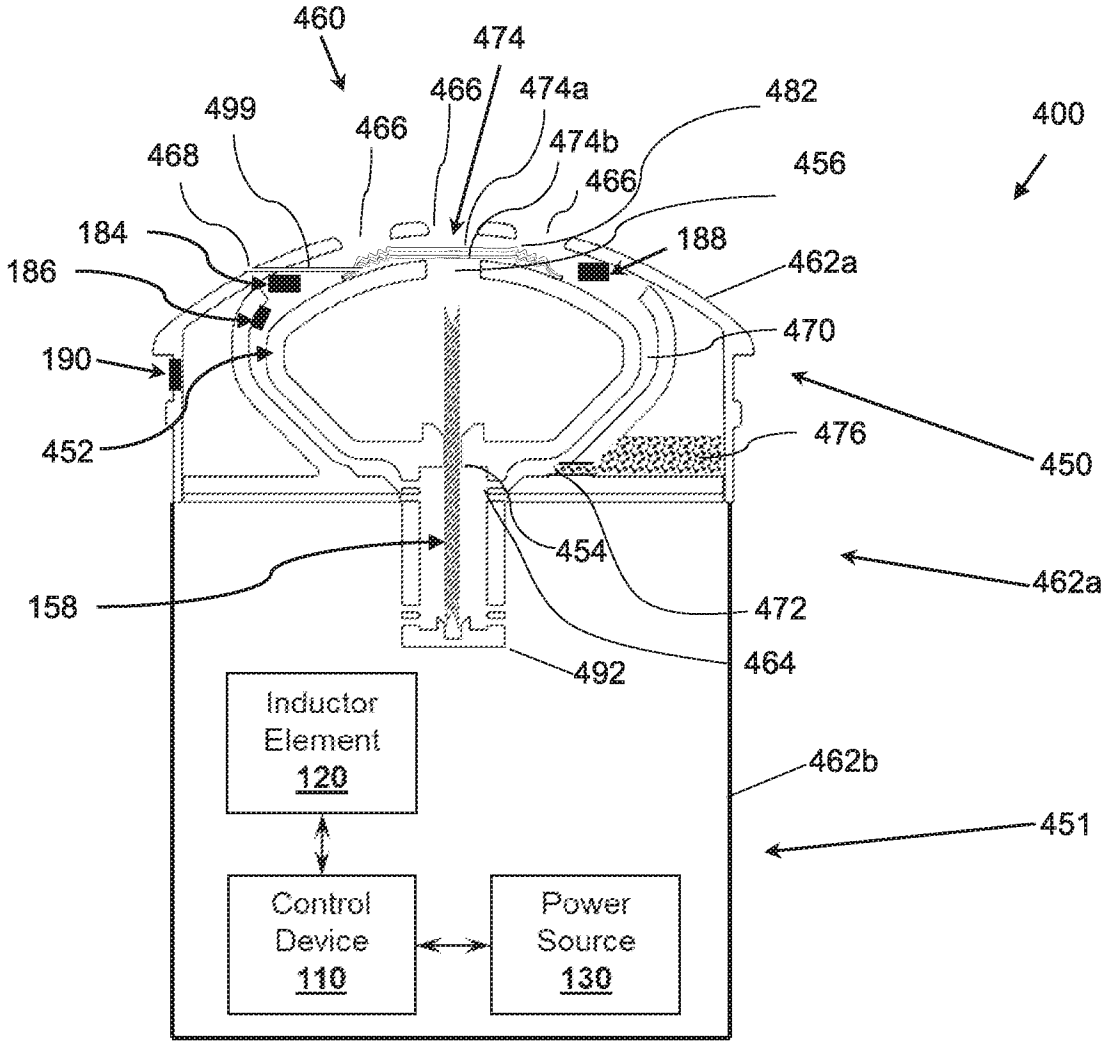
FIG. 4 is a diagram of a non-limiting embodiment of a vaporizer device.

In some non-limiting embodiments, first housing section 162*a* and reservoir 152 (e.g., at least a portion of reservoir 152) may define channel 170. In some non-limiting embodiments, second housing section 162*b* and reservoir 152 (e.g., at least a portion of reservoir 152) may define channel 170. In some non-limiting embodiments, channel 170 may include a non-linear channel. For example, channel 170 may include a plurality of cross-sectional areas that vary (e.g., that increase and/or decrease by between up to 20% between the smallest cross-sectional area and the largest cross-sectional area) along channel 170. In such an example, portions of channel 170 that have wider cross-sectional areas than other portions of channel 170 that have less-wide cross-sectional areas may have drops of aerosolized material (e.g., aerosolizable substance that has been aerosolized) that condensate and/or aggregate in the portions of channel 170 that have wider cross-sectional areas than other portions of channel 170. In this example, the drops of aerosolized material may collect and enter an orifice (e.g., orifice 472 as shown in FIG. 4) and the drops may be absorbed by an absorbent material (e.g., absorbent material 476 shown in FIG. 4), such as cotton, wool, and/or the like. In some non-limiting embodiments, valve 174, temperature sensor 184, pressure sensor 188, and/or pressure sensor 190 may be positioned within channel 170. For example, valve 174, temperature sensor 184, pressure sensor 188, and/or pressure sensor 190 may be positioned entirely within or at least partially within channel 170.

In some non-limiting embodiments, the flow of air between third opening 164 and fourth opening 166 of housing 162 may cause leakage prevention structure 160 to transition to an open position. For example, the flow of air between third opening 164 and fourth opening 166 of housing 162 may cause pressure within channel 170 to decrease. In such an example, the pressure within channel 170 may decrease based on suction generated at fourth opening 166 (e.g., at mouthpiece component 180 that is adjacent fourth opening 166). In some non-limiting embodiments, leakage prevention structure 160 may be configured to transition to the open position based on the decrease of pressure within channel 170. Additionally or alternatively, the cessation of the flow of air between third opening 164 and fourth opening 166 of housing 162 may cause leakage prevention structure 160 to transition to the closed position. For example, the cessation of the flow of air between third opening 164 and fourth opening 166 of housing 162 may cause pressure within channel 170 to increase. In such an example, leakage prevention structure 160 may be configured to transition to the closed position based on the increase of pressure within channel 170.

In some non-limiting embodiments, valve 174 may be configured to control the flow of air into reservoir 152 (e.g., by sealing reservoir 152 or by unsealing reservoir 152) during operation of vaporizer device 100. For example, valve 174 may include a flexible material that is configured to control the flow of air into reservoir 152 during operation of vaporizer device 100. In some non-limiting embodiments, valve 174 may be sized and/or configured to fit over (e.g., to cover) second opening 156 of reservoir 152. In some non-limiting embodiments, valve 174 may be sized and/or configured to fit over fifth opening 168 of housing 162. For example, valve 174 may be sized and/or configured to fit over fifth opening 168 of housing 162. In some non-limiting embodiments, valve 174 may be configured to control the flow of air between fifth opening 168 of housing 162 and second opening 156 of reservoir 152. In some non-limiting embodiments, when valve 174 is in the closed position, reservoir 152 may be in the sealed state and valve 174 may prevent the aerosolizable substance included in reservoir 152 from being transferred through first opening 154 of reservoir 152. Additionally or alternatively, when valve 174 is in the open position, reservoir 152 may be in the unsealed state and valve 174 may enable the aerosolizable substance included in reservoir 152 to be transferred through first opening 154 of reservoir 152.

In some non-limiting embodiments, actuator 182 is configured to cause valve 174 to transition between a closed position and an open position. In some non-limiting embodiments, actuator 182 may include a bimetallic strip that is configured to cause valve 174 to transition between the closed position and the open position based on the bimetallic strip receiving energy (e.g., energy in the form of heat, energy in the form of an electrical current, etc.) from one or more components of vaporizer device 100. For example, actuator 182 may include a bimetallic strip that is configured to cause valve 174 to transition between the closed position and the open position based on the bimetallic strip receiving energy from power source 130 based on a control signal from control device 110.

In some non-limiting embodiments, temperature sensor 184 may include one or more devices configured to obtain data associated with a temperature. For example, temperature sensor 184 may include a thermocouple, a silicon sensor chip, an infrared thermometer, and/or the like. In some non-limiting embodiments, temperature sensor 184 may be configured to obtain data associated with a temperature within channel 170. For example, temperature sensor 184 may be positioned within channel 170 (e.g., entirely within, at least partially within, etc.).

In some non-limiting embodiments, pressure sensor 188 and/or pressure sensor 190 may include one or more devices configured to obtain data associated with a pressure at a location associated with vaporizer device 100. For example, pressure sensor 188 and/or pressure sensor 190 may include an aneroid barometer sensor, a manometer sensor, a Bourdon tube pressure sensor, a vacuum pressure sensor, a sealed pressure sensor, and/or the like. In some non-limiting embodiments, pressure sensor 188 may be configured to obtain data associated with a pressure within channel 170. For example, pressure sensor 188 may be positioned within channel 170 (e.g., entirely within, at least partially within, etc.). In some non-limiting embodiments, pressure sensor 190 may be configured to obtain data associated with a pressure outside vaporizer device 100. For example, pressure sensor 190 may be positioned outside vaporizer device 100 (e.g., entirely outside, at least partially outside, etc.). In some non-limiting embodiments, pressure sensor 190 may be positioned along an exterior surface of housing 162 and/or pressure sensor 190 may be at least partially included in housing 162.

In some non-limiting embodiments, control device 110 may control valve 174. For example, control device 110 may control valve 174 to transition between the open position and the closed position. In some non-limiting embodiments, control device 110 may control actuator 182. For example, control device 110 may control actuator 182 to transition valve 174 between the open position and the closed position. In some non-limiting embodiments, control device 110 may control actuator 182 to transition valve 174 between the open position and the closed position based on the data associated with the temperature inside channel 170.

In some non-limiting embodiments, when an amount of pressure within channel 170 satisfies a pressure threshold associated with the unsealed state of reservoir 152, leakage prevention structure 160 (e.g., valve 174 of leakage prevention structure 160) may be configured to transition from the closed position to the open position based on the amount of pressure within channel 170. Additionally or alternatively, when the amount of pressure within channel 170 does not satisfy the pressure threshold associated with the unsealed state of reservoir 152, leakage prevention structure 160 may be configured to transition from the open position to the closed position based on the amount of pressure within channel 170.

In some non-limiting embodiments, control device 110 may determine whether an amount of pressure within channel 170 satisfies a pressure threshold. For example, control device 110 may determine whether an amount of pressure within channel 170 satisfies a pressure threshold associated with the unsealed state of reservoir 152. In some non-limiting embodiments, control device 110 may cause leakage prevention structure 160 (e.g., valve 174 of leakage prevention structure 160) to transition to the open position or to the closed position based on determining whether pressure within channel 170 satisfies the pressure threshold associated with the unsealed state of reservoir 152. Additionally or alternatively, control device 110 may cause valve 174 to transition to the open position or to the closed position based on determining whether pressure within channel 170 satisfies the pressure threshold associated with the sealed state of reservoir 152.

In some non-limiting embodiments, control device 110 may receive data associated with an amount of pressure within channel 170. For example, control device 110 may receive data associated with an amount of pressure within channel 170 from pressure sensor 188 positioned within channel 170. In some non-limiting embodiments, control device 110 may receive data associated with an amount of pressure outside vaporizer device 100. For example, control device 110 may receive data associated with an amount of pressure outside vaporizer device 100 from pressure sensor 190 positioned outside vaporizer device 100. In some non-limiting embodiments, control device 110 may determine a difference between the pressure within channel 170 and the pressure outside vaporizer device 100. In some non-limiting embodiments, control device 110 may cause valve 174 to transition to the open position or the closed position based on the difference between the pressure within channel 170 and the pressure outside vaporizer device 100.

In some non-limiting embodiments, an amount of the aerosolizable substance transferred from reservoir 152 via susceptor element 158 to an area outside of reservoir 152 may be determined at least in part based on a pressure inside reservoir 152. The pressure inside reservoir 152 may be associated with the position of valve 174 coupled to reservoir 152. In some non-limiting embodiments, the amount of the aerosolizable substance transferred from reservoir 152 via susceptor element 158 may increase when the pressure inside reservoir 152 increases (e.g., when valve 174 is in and/or transitions to the open position). Additionally or alternatively, the amount of the aerosolizable substance transferred from reservoir 152 via susceptor element 158 may decrease when the pressure inside reservoir 152 decreases (e.g., when valve 174 is in the closed position and/or transitions to the closed position).

In some non-limiting embodiments, control device 110 may receive data associated with the temperature inside channel 170. For example, control device 110 may receive data associated with the temperature inside channel 170, and control device 110 may determine whether the temperature inside channel 170 has increased or decreased. In some non-limiting embodiments, control device 110 may determine whether the temperature inside channel 170 has increased at a predetermined rate (e.g., a predetermined rate associated with the generation of suction at mouthpiece component 180). In some non-limiting embodiments, control device 110 may cause heating element 186 to generate thermal energy. For example, control device 110 may cause heating element 186 to generate thermal energy based on control device 110 determining that the temperature inside channel 170 has increased at the predetermined rate. In such an example, actuator 182 may be configured to transition to the open position based on heating element 186 generating thermal energy.

In some non-limiting embodiments, control device 110 may receive data associated with the temperature inside channel 170. In some non-limiting embodiments, control device 110 may determine whether a temperature inside channel 170 has increased at a predetermined rate. For example, control device 110 may determine whether a temperature inside channel 170 has increased at a predetermined rate during a time (e.g., during a period of time). In some non-limiting embodiments, control device 110 may cause heating element 186 to generate thermal energy based on determining that the temperature inside channel 170 has increased at the predetermined rate. Additionally or alternatively, control device 110 may forego causing heating element 186 to generate thermal energy based on determining that the temperature inside channel 170 has not increased at the predetermined rate. In some non-limiting embodiments, valve 174 may be configured to transition to the closed position based on heating element 186 foregoing generating thermal energy. Additionally or alternatively, valve 174 may be configured to transition to the open position based on heating element 186 generating thermal energy. In some non-limiting embodiments, control device 110 may control susceptor element 158 to generate thermal energy to transition reservoir 152 between the sealed state and the unsealed state.

Figure 3A:
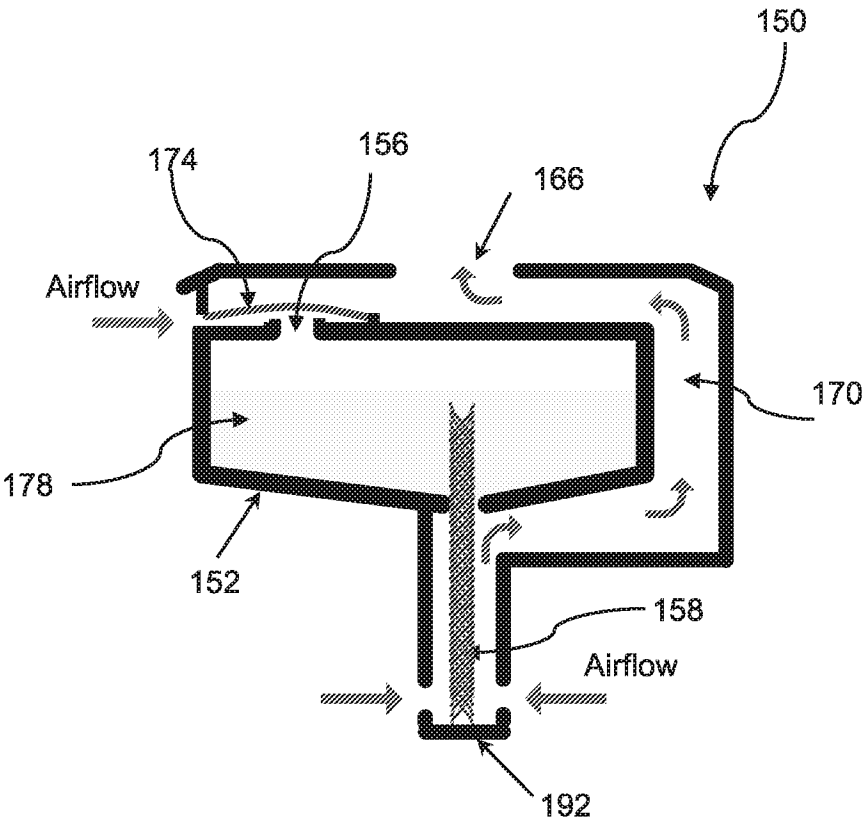
FIGS. 3A and 3B are simplified schematic diagrams of components of a non-limiting embodiment of the vaporizer device shown in FIGS. 1A-2.
Figure 3B:
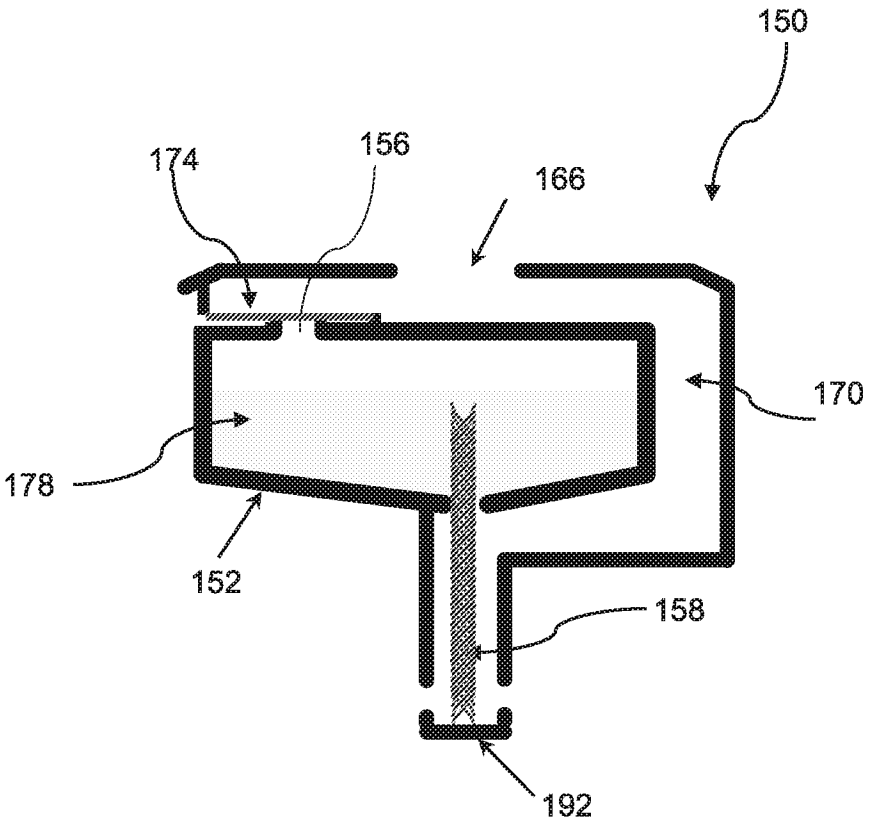

FIGS. 3A and 3B are simplified schematic diagrams that illustrate the operation of vaporizer device 100 based on components shown in first portion 150 of vaporizer device 100. As shown in FIGS. 3A and 3B, vaporizer device 100 may include aerosolizable substance 178 in reservoir 152. In some non-limiting embodiments, to use vaporizer device 100, a user may generate suction at fourth opening 166. The suction may cause air to flow through channel 170. As shown in FIGS. 3A and 3B, airflow is represented by arrows in bold. As further shown in FIGS. 3A and 3B, the air may flow through channel 170 and the air may pass along at least a portion of susceptor element 158 and the air may carry an aerosol that is generated based on susceptor element 158 heating aerosolizable substance 178 in reservoir 152. In some non-limiting embodiments, susceptor element 158 may generate heat based on the electromagnetic energy that is absorbed and/or provide heat to aerosolizable substance 178 that is in thermal contact with at least a portion of susceptor element 158. In some non-limiting embodiments, a user may generate suction at fourth opening 166 of housing 162 and cause air to flow along at least a portion of susceptor element 158 and through third opening 164 of housing 162. In some non-limiting embodiments, the air may flow from third opening 164 of housing 162 through channel 170 and through fourth opening 166.

In some non-limiting embodiments, aerosolizable substance 178 that is in thermal contact (e.g., in physical contact with so that thermal energy can be transferred) with at least a portion of susceptor element 158 may be aerosolized based on receiving heat from susceptor element 158. In some non-limiting embodiments, aerosolizable substance 178 that is aerosolized may be transported via the air flowing from third opening 164 of housing 162 through channel 170 and through fourth opening 166.

As shown in FIG. 3A, when reservoir 152 is in the sealed state, valve 174 may be in a closed position. In some non-limiting embodiments, when in the closed position, valve 174 may prevent aerosolizable substance 178 from being transferred through opening 154 of reservoir 152. As shown in FIG. 3B, when reservoir 152 is in the unsealed state, valve 174 may be in an open position. In some non-limiting embodiments, when in the open position, valve 174 enables aerosolizable substance 178 to be transferred through opening 154 of reservoir 152.

As further shown in FIG. 3A, the flow of air between third opening 164 and fourth opening 166 of housing 162 may cause leakage prevention structure 160 to transition to an open position. For example, the flow of air between third opening 164 and fourth opening 166 of housing 162 may cause pressure within channel 170 to decrease. In such an example, aerosolizable substance 178 may be allowed to be transferred through opening 154 of reservoir 152 via susceptor element 158 toward secondary reservoir 192.

As shown in FIG. 3B, a cessation of the flow of air between third opening 164 and fourth opening 166 of housing 162 may cause leakage prevention structure 160 to transition to the closed position. For example, the cessation of the flow of air between third opening 164 and fourth opening 166 of housing 162 may cause pressure within channel 170 to increase. In such an example, leakage prevention structure 160 may be configured to transition to the closed position based on the increase of pressure within channel 170. In some non-limiting embodiments, when leakage prevention structure 160 transitions reservoir 152 from the unsealed state to the sealed state, the vacuum may be formed in reservoir 152, and the flow of air through second opening 156 of reservoir 152 may be disabled. In such an example, aerosolizable substance 178 may be prevented from being transferred through opening 154 of reservoir 152 via susceptor element 158 toward secondary reservoir 192.

FIG. 4 is a diagram of vaporizer device 400. It is noted that all components of vaporizer device 400 shown in FIG. 4 are not required in each and every embodiment, but the components of vaporizer device 400 are shown in FIG. 4 for purposes of complete illustration.

As shown in FIG. 4, vaporizer device 400 includes first portion 450 and second portion 451. For the purpose of illustration, FIG. 4 depicts vaporizer device 400 where first portion 450 and second portion 451 are coupled via an interference fit. In some non-limiting embodiments, vaporizer device 400 may include reservoir 452, susceptor element 158, leakage prevention structure 460, housing 462*a* and 462*b*, valve 474, mouthpiece component 180, actuator 482, temperature sensor 184, heating element 186, pressure sensor 188, and/or pressure sensor 190. In some non-limiting embodiments, vaporizer device 400 may include control device 110, inductor element 120, and/or power source 130, described above. In some non-limiting embodiments, one or more components of vaporizer device 400 may be the same as, or similar to, one or more components of vaporizer device 100, as described herein. For example, one or more of reservoir 452, susceptor element 158, leakage prevention structure 460, housing 462, valve 474, mouthpiece component 180, actuator 482, temperature sensor 184, heating element 186, pressure sensor 188, and/or pressure sensor 190 may be the same as or similar to one or more of reservoir 152, susceptor element 158, leakage prevention structure 160, housing 162, valve 174, mouthpiece component 180, actuator 182, temperature sensor 184, heating element 186, pressure sensor 188, and/or pressure sensor 190, respectively.

As shown in FIG. 4, first portion 450 of vaporizer device 400 may include reservoir 452, susceptor element 158, leakage prevention structure 460, housing 462, valve 474, actuator 482, temperature sensor 184, pressure sensor 188, pressure sensor 190, and/or secondary reservoir 492. For example, first portion 450 of vaporizer device 400 may include reservoir 452, susceptor element 158, leakage prevention structure 460, housing 462, valve 474, actuator 482, temperature sensor 184, pressure sensor 188, and/or pressure sensor 190 that are surrounded (e.g., partially surrounded and/or completely surrounded) by first housing section 462*a* of vaporizer device 400. In some non-limiting embodiments, second portion 451 of vaporizer device 400 may include control device 110, inductor element 120, and/or power source 130. For example, second portion 451 of vaporizer device 400 may include control device 110, inductor element 120, and/or power source 130 that are surrounded (e.g., partially surrounded and/or completely surrounded) by second housing section 462*b*. In some non-limiting embodiments, one or more components included in first portion 450 may additionally, or alternatively, be included in second portion 451. Similarly, in some non-limiting embodiments, one or more components included in second portion 451 may additionally, or alternatively, be included in first portion 450. In some non-limiting embodiments, some or all of the components of vaporizer device 400, described herein, may be the same as or similar to some or all of the components of vaporizer device 100, described above.

In some non-limiting embodiments, reservoir 452 may be the same or similar to reservoir 152. In some non-limiting embodiments, susceptor element 158 may be the same or similar to susceptor element 158. In some non-limiting embodiments, susceptor element 158 may extend through at least a portion of first opening 454 of reservoir 452. In some non-limiting embodiments, housing 462*a* and 462*b* may be the same or similar to housing 162*a* and 162*b*. In some non-limiting embodiments, valve 474 may be the same or similar to valve 174. In some non-limiting embodiments, actuator 482 may be the same as or similar to actuator 182. In some non-limiting embodiments, secondary reservoir 492 may be the same as or similar to secondary reservoir 192.

In some non-limiting embodiments, leakage prevention structure 460 may include one or more components that cooperate to prevent aerosolizable substances from leaving vaporizer device 400. For example, leakage prevention structure 460 may include valve 474. Additionally or alternatively, leakage prevention structure 460 may include valve 474 and/or secondary duct 499. In some non-limiting embodiments, leakage prevention structure 460 may be the same or similar to leakage prevention structure 160.

In some non-limiting embodiments, housing 462 may include third opening 464 and/or fourth opening 466. In some non-limiting embodiments, fourth opening 466 may include a plurality of openings. For example, fourth opening 466 may include a plurality of openings where at least one opening is aligned along an axis of reservoir 452 and/or susceptor element 158. In some non-limiting embodiments, housing 462*a* may include fifth opening 468. In some non-limiting embodiments, secondary duct 499 may be coupled to fifth opening 468 to enable the flow of air from outside vaporizer device 400 into reservoir 452. In some non-limiting embodiments, housing 462 may define channel 470. In some non-limiting embodiments, housing 462 may include orifice 472. For example, orifice 472 may be configured to collect liquid that passes through channel 470, where the liquid is not aerosolized. In some non-limiting embodiments, housing 462 may include absorbent material 476 (e.g., cotton, wool, and/or the like). Absorbent material 476 may absorb liquid that passes through orifice 472 that is not aerosolized.

In some non-limiting embodiments, valve 474 may include a flexible membrane that is configured to control airflow and/or seal off reservoir 452 during operation of vaporizer device 400. In some non-limiting embodiments, the flexible membrane of valve 474 may include first portion 474*a* that extends across second opening 456 of reservoir 452 and second portion 474*b* that couples to the exterior surface of reservoir 452. In some non-limiting embodiments, second portion 474*b* may be folded to enable valve 474 to extend toward the open position and to retract toward the closed position. In some non-limiting embodiments, valve 474 may include at least a portion of secondary duct 499 extending through to enable airflow between an environment outside of vaporizer device 400 and reservoir 452.

Figure 5:
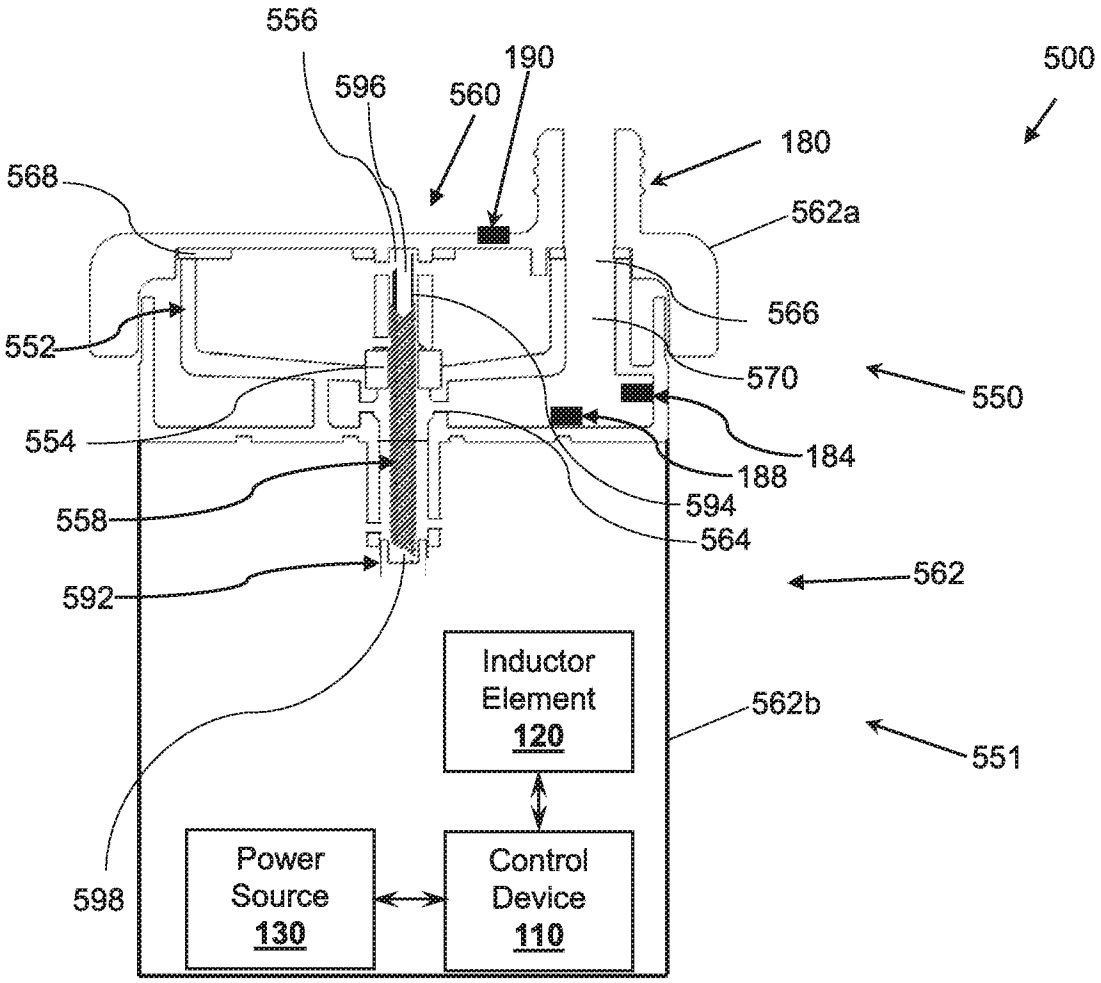
FIG. 5 is a diagram of a non-limiting embodiment of a vaporizer device.

FIG. 5 is a diagram of vaporizer device 500. It is noted that all components of vaporizer device 500 shown in FIG. 5 are not required in each and every embodiment, but the components of vaporizer device 500 are shown in FIG. 5 for purposes of complete illustration. As shown in FIG. 5, vaporizer device 500 includes first portion 550 and second portion 551. In some non-limiting embodiments, first portion 550 and second portion 551 are coupled via an interference fit.

In some non-limiting embodiments, vaporizer device 500 may include reservoir 552, susceptor element 558, leakage prevention structure 560, housing 562 (e.g., first housing section 562*a* and second housing section 562*b*), mouthpiece component 180, temperature sensor 184, heating element 186, pressure sensor 188, and/or pressure sensor 190. In some non-limiting embodiments, vaporizer device 500 may include control device 110, inductor element 120, and/or power source 130. In some non-limiting embodiments, vaporizer device 500 may include control device 110, inductor element 120, and/or power source 130, described above. As shown in FIG. 5, first portion 550 of vaporizer device 500 may include reservoir 552, susceptor element 558, leakage prevention structure 560, housing 562, mouthpiece component 180, temperature sensor 184, pressure sensor 188, and/or pressure sensor 190.

In some non-limiting embodiments, second portion 551 of vaporizer device 500 may include control device 110, inductor element 120, and/or power source 130. For example, second portion 551 of vaporizer device 500 may include control device 110, inductor element 120, and/or power source 130 that are surrounded (e.g., partially surrounded and/or completely surrounded) by second housing section 562*b*. In some non-limiting embodiments, one or more components included in first portion 550 may additionally, or alternatively, be included in second portion 551. Similarly, in some non-limiting embodiments, one or more components included in second portion 551 may additionally, or alternatively, be included in first portion 550.

In some non-limiting embodiments, some or all of the components of vaporizer device 500, described herein, may be the same as or similar to some or all of the components of vaporizer device 100 and/or vaporizer device 400, described above. For example, one or more of reservoir 552, susceptor element 558, leakage prevention structure 560, and/or housing 562 may be the same as or similar to one or more of reservoir 152, susceptor element 158, leakage prevention structure 160, and/or housing 162, respectively.

In some non-limiting embodiments, reservoir 552 may be configured to hold an aerosolizable substance. In some non-limiting embodiments, reservoir 552 may include first opening 554 and/or second opening 556. In some non-limiting embodiments, susceptor element 558 may be positioned within (e.g., entirely within, at least partially within, etc.) first opening 554 of reservoir 552. Susceptor element 558 may be configured to transfer the aerosolizable substance from reservoir 552 through first opening 554 via a capillary action of susceptor element 558. In some non-limiting embodiments, reservoir 552 may be configured to hold an aerosolizable substance that is a liquid.

In some non-limiting embodiments, leakage prevention structure 560 may include one or more components that cooperate to prevent aerosolizable substances from leaving vaporizer device 500 in a non-aerosolized form and, as a result, by being ingested by a user associated with (e.g., operating) vaporizer device 500. In some non-limiting embodiments, leakage prevention structure 560 may be configured to transition reservoir 552 between a sealed state to an unsealed state. For example, when leakage prevention structure 560 transitions reservoir 552 from the sealed state to the unsealed state, a vacuum associated with reservoir 552 may be released and a flow of air through second opening 556 of reservoir 552 may be enabled. Additionally or alternatively, when leakage prevention structure 560 transitions reservoir 552 from the unsealed state to the sealed state, a vacuum associated with reservoir 552 may be formed in reservoir 552, and the flow of air through second opening 556 of reservoir 552 may be disabled.

In some non-limiting embodiments, when an amount of aerosolizable substance included in secondary reservoir 592 is at a predetermined amount, reservoir 552 may be in a sealed state. Additionally or alternatively, when an amount of aerosolizable substance included in secondary reservoir 592 is not at the predetermined amount, reservoir 552 may be in an unsealed state.

In some non-limiting embodiments, leakage prevention structure 560 may include duct 594. For example, leakage prevention structure 560 may include duct 594 positioned within and extending through first opening 554 of reservoir 552. In some non-limiting embodiments, duct 594 may be configured to control airflow and/or seal off reservoir 552 in conjunction with aerosolizable substance located in secondary reservoir 592 during operation of vaporizer device 500.

In some non-limiting embodiments, duct 594 may be positioned within first opening 554 and an opening of first end portion 596 of duct 594 may constitute second opening 556 of reservoir 552. In some non-limiting embodiments, duct 594 may be configured to control airflow into and/or out of reservoir 552, as described herein.

In some non-limiting embodiments, secondary reservoir 592 may be positioned opposite first opening 554 of reservoir 552. In some non-limiting embodiments, at least a portion of susceptor element 558 may be positioned within secondary reservoir 592. In some non-limiting embodiments, housing 562 and secondary reservoir 592 may define one or more openings that enable air to flow along susceptor element 558 and then through third opening 564 of housing 562. Susceptor element 558 may be configured to generate thermal energy (e.g., heat), the thermal energy may causes an amount of the aerosolizable substance associated with (e.g., in contact with) susceptor element 558 to be aerosolized, and, when aerosolizing the aerosolizable substance, susceptor element 558 absorbs the aerosolizable substance from secondary reservoir 592.

In some non-limiting embodiments, duct 594 may include first end portion 596, second end portion 598, and a channel between first end portion 596 and second end portion 598. In such an example, the channel may allow air to flow within duct 594. In some non-limiting embodiments, first end portion 596 of duct 594 may be positioned within reservoir 552. For example, first end portion 596 of duct 594 may extend through second opening 556 of reservoir 552. In such an example, the channel of duct 594 may include first opening 554 of reservoir 552. Additionally or alternatively, second end portion 598 of duct 594 may be positioned within secondary reservoir 592.

In some non-limiting embodiments, duct 594 (e.g., at least a portion of duct 594) extends through first opening 554 of the reservoir. In some non-limiting embodiments, an opening at first end portion 596 of duct 594 defines first opening 554 of reservoir 552. In some non-limiting embodiments, susceptor element 558 may be positioned coaxially with regard to duct 594. For example, susceptor element 558 may be positioned within and extend through first opening 554 of reservoir 552, such that susceptor element 558 is within first opening 554 and surrounding duct 594. In some non-limiting embodiments, susceptor element 558 may be positioned between the portion of duct 594 that extends through first opening 554 of reservoir 552 and first opening 554 of reservoir 552. For example, susceptor element 558 may be positioned between a face of reservoir 552 that defines first opening 554 of reservoir 552 and duct 594.

In some non-limiting embodiments, housing 562 may include first housing section **562*a* and second housing section 562*b*. For example, housing 562 may be sized and/or configured to surround the components of vaporizer device 500, as described above. In some non-limiting embodiments, housing 562 may include fifth opening 568. For example, housing 562 may include fifth opening 568 that enables air to flow from an environment outside housing 562 into channel 570. In some non-limiting embodiments, housing 562 may be constructed from any suitable material such as wood, metal, fiberglass, plastic, and/or the like. In some non-limiting embodiments, housing 562 may include mouthpiece component 180. For example, housing 562 may include mouthpiece component 180, where mouthpiece component 180** is interchangeable.

In some non-limiting embodiments, vaporizer device 500 may include channel 570 extending through first portion 550 and/or second portion 551 of housing 562. As shown in FIG. 5, channel 570 may extend between third opening 564 and fourth opening 566 of housing 562 to enable airflow through channel 570 between third opening 564 and fourth opening 566 of housing 562. Channel 570 may be defined within housing 562 that connects third opening 564 and fourth opening 566. In some non-limiting embodiments, first housing section **562*a* and/or second housing section 562*b* may cooperate with at least a portion of reservoir 552 to define channel 570. In some non-limiting embodiments, channel 570 may include a non-linear channel, as described herein. In some non-limiting embodiments, channel 570 may include temperature sensor 184, pressure sensor 188, and/or pressure sensor 190. For example, temperature sensor 184, pressure sensor 188, and/or pressure sensor 190 may be positioned within (e.g., entirely within, at least partially within, etc.) channel 570**.

In some non-limiting embodiments, control device 110 may control susceptor element 558 to generate thermal energy to transition reservoir 552 between the sealed state and the unsealed state. For example, control device 110 may cause susceptor element 558 to generate heat to aerosolize the aerosolizable substance in secondary reservoir 592. When a predetermined amount of the aerosolizable substance in secondary reservoir 592 has been aerosolized, second end portion 598 of duct 594 may be open and air may flow through duct 594 and into reservoir 552. When air flows into reservoir 552 through duct 594, reservoir 552 may transition between the sealed state and the unsealed state.

In some non-limiting embodiments, temperature sensor 184 may be configured to obtain data associated with a temperature within channel 570. For example, temperature sensor 184 may be positioned within (e.g., entirely within, at least partially within, etc.) channel 570. In some non-limiting embodiments, control device 110 may control susceptor element 558 to generate thermal energy to transition reservoir 552 between the sealed state and the unsealed state based on data associated with a temperature within channel 570. For example, control device 110 may control susceptor element 558 to generate thermal energy to transition reservoir 552 between the sealed state and the unsealed state based on data associated with the temperature received from temperature sensor 184.

In some non-limiting embodiments, pressure sensor 188 may be positioned within channel 570 and pressure sensor 188 may be configured to obtain data associated with a pressure within channel 570. In some non-limiting embodiments, pressure sensor 190 may be positioned outside vaporizer device 500 and pressure sensor 190 may be configured to obtain data associated with a pressure outside vaporizer device 500. For example, pressure sensor 190 may be positioned along an exterior surface of housing 562 and/or pressure sensor 190 may be at least partially included in housing 562. In such an example, pressure sensor 190 may be configured to obtain data associated with a pressure outside vaporizer device 500.

In some non-limiting embodiments, control device 110 may control susceptor element 558 to generate thermal energy to transition reservoir 552 between the sealed state and the unsealed state based on data associated with a pressure within channel 570 and/or data associated with a pressure outside channel 570. For example, control device 110 may control susceptor element 558 to generate thermal energy to transition reservoir 552 between the sealed state and the unsealed state based on data associated with the pressure received from pressure sensor 188 and/or pressure sensor 190.

FIGS. 6A-6D are simplified schematic diagrams that illustrate the operation of vaporizer device 500 based on components shown in first portion 550 of vaporizer device 500. As shown in FIGS. 6A-6D, vaporizer device 500 may include aerosolizable substance 178 in reservoir 552. In some non-limiting embodiments, aerosolizable substance 178 may be transferred (e.g., may flow) from reservoir 552 through first opening 554 of reservoir 552 to secondary reservoir 592. For example, aerosolizable substance 178 may be transferred from reservoir 552 through first opening 554 of reservoir 552 via susceptor element 558 to secondary reservoir 592. In such an example, aerosolizable substance 178 may be transferred from reservoir 552 to secondary reservoir 592 when a pressure inside reservoir 552 is greater than or equal to a pressure outside of reservoir 552. In some non-limiting embodiments, an amount of aerosolizable substance 178 may be included in secondary reservoir 592. For example, an amount of aerosolizable substance 578 may be transferred from reservoir 552 to secondary reservoir 592.

Figure 6A:
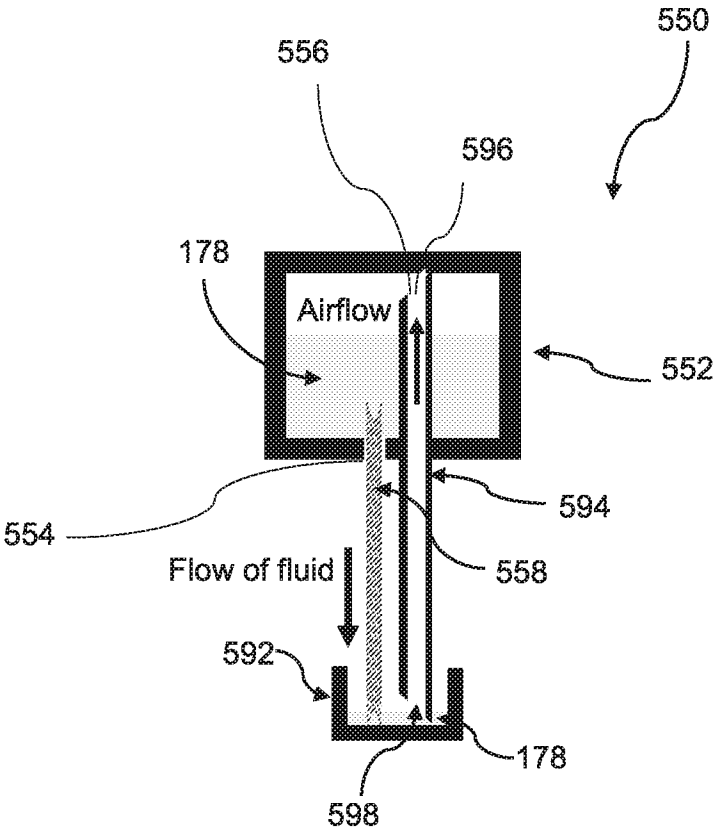
FIGS. 6A-6D are simplified schematic diagrams of components of a non-limiting embodiment of the vaporizer device shown in FIG. 5.
Figure 6B:
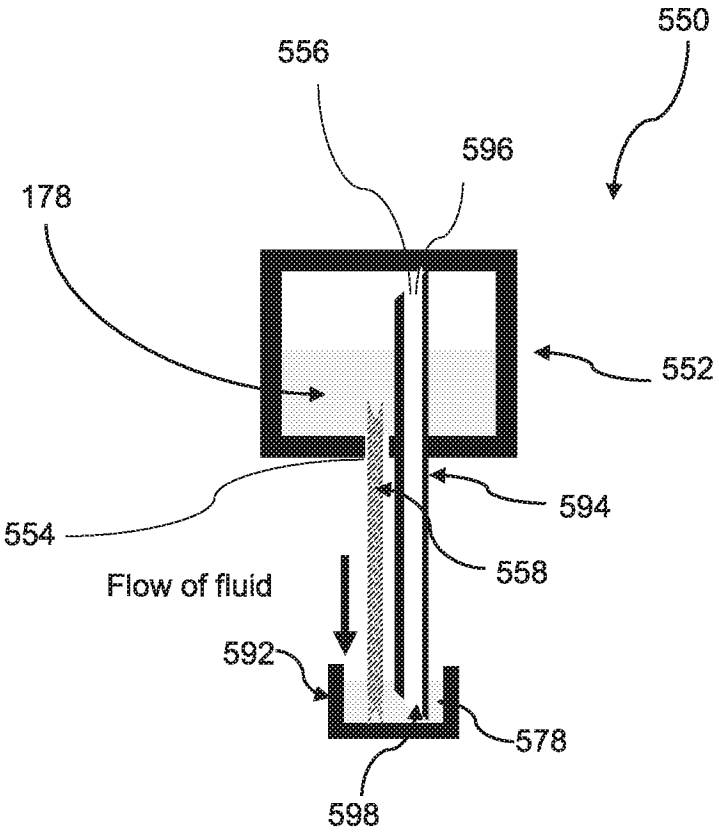

As further shown in FIG. 6B, the amount of aerosolizable substance 178 included in secondary reservoir 592 may prevent the flow of air into reservoir 552. For example, the amount of aerosolizable substance 178 included in secondary reservoir 592 may prevent the flow of air into reservoir 552 when second end portion 598 of duct 594 is submerged in aerosolizable substance 178. In some non-limiting embodiments, when second end portion 598 of duct 594 is submerged in aerosolizable substance 178 the flow of air through duct 594 may be prevented. For example, when second end portion 598 of duct 594 is submerged in aerosolizable substance 178 the flow of air through duct 594 may be prevented and a vacuum may form in reservoir 552. In some non-limiting embodiments, once the vacuum forms in reservoir 552 the remaining portion of aerosolizable substance 178 may be retained in reservoir 552.

Figure 6C:
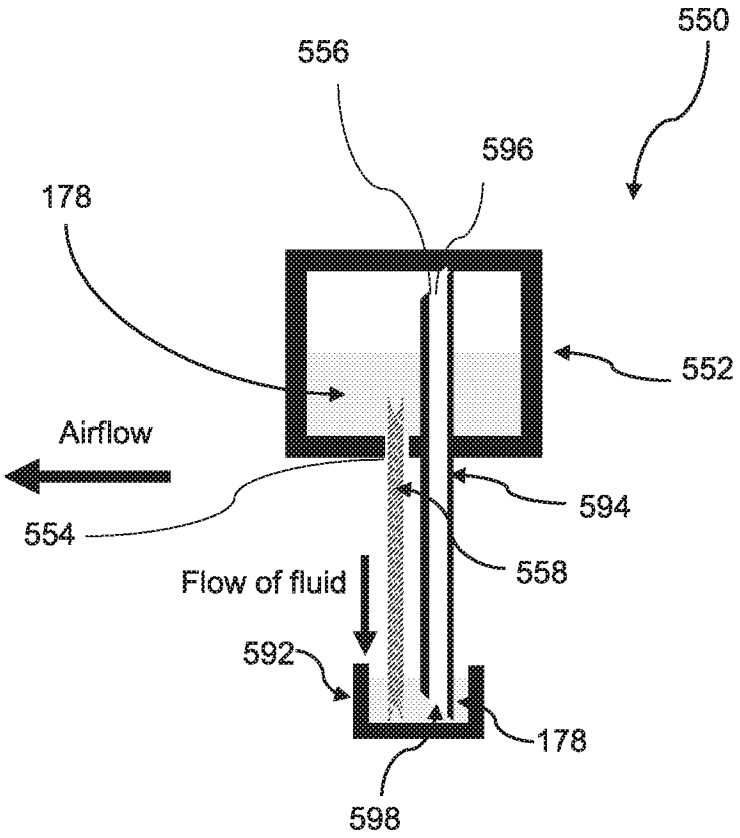

As further shown in FIG. 6C, susceptor element 558 may generate heat. For example, susceptor element 558 may generate heat and susceptor element 558 may cause aerosolizable substance 178 included in susceptor element 558 to be aerosolized. In some non-limiting embodiments, the aerosolizable substance 178 that is aerosolized by susceptor element 558 may be carried away from susceptor element 558 via an air flow. In some non-limiting embodiments, the pressure inside reservoir 552 may decrease based on the aerosolizable substance 178 that is aerosolized by susceptor element 558 being carried away from susceptor element 558 via the flow of air across susceptor element 558. In some non-limiting embodiments, aerosolizable substance 178 that is included in secondary reservoir 592 may be absorbed by susceptor element 558.

Figure 6D:
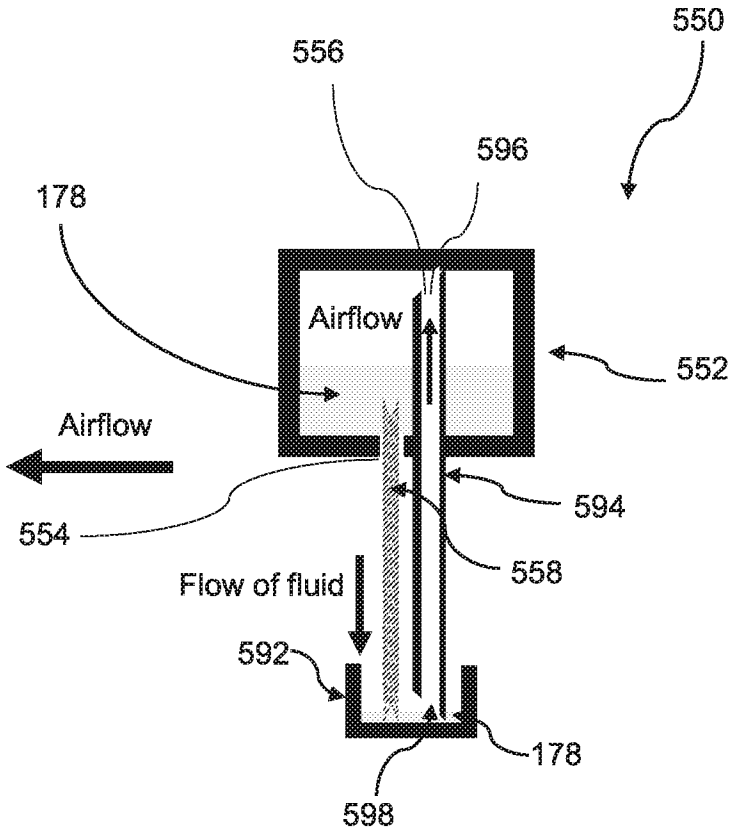

As shown in FIG. 6D, duct 594 may enable air to flow through second opening 556 of reservoir 552. For example, duct 594 may enable air to flow through second opening 556 of reservoir 552 when an amount of aerosolized substance 178 included in secondary reservoir 592 is not at a predetermined amount. In some non-limiting embodiments, when the amount of aerosolizable substance 178 included in secondary reservoir 592 is equal to or less than the predetermined amount, air may flow from second end portion 598 of duct 594 to first end portion 596 of duct 594. In some non-limiting embodiments, as air flows from second end portion 598 of duct 594 to first end portion 596 of duct 594, the pressure inside reservoir 552 may increase.

Figure 7:
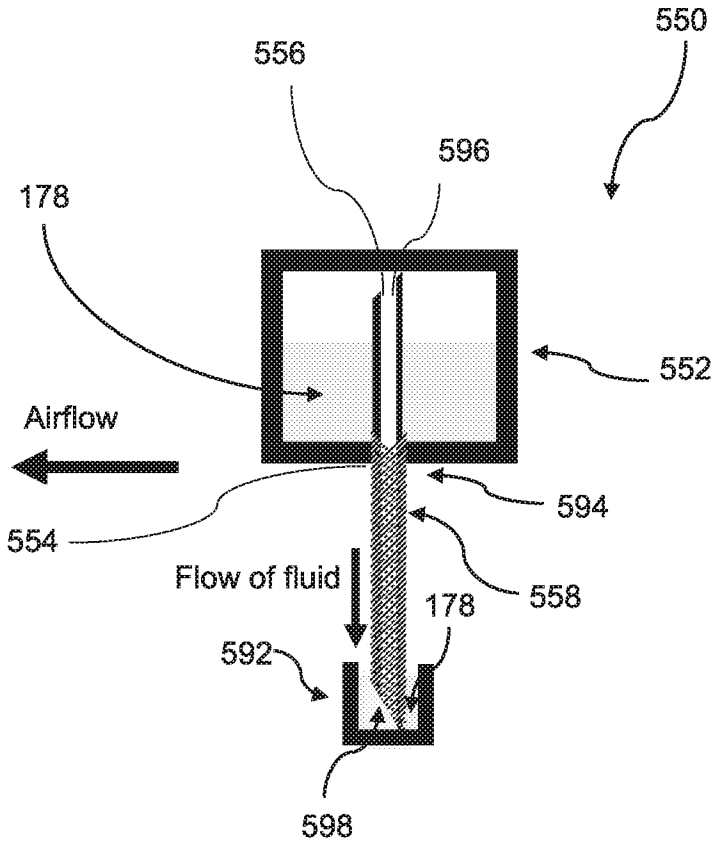
FIG. 7 is a simplified schematic diagram of components of a non-limiting embodiment of the vaporizer device shown in FIG. 5.

FIG. 7 is a diagram of vaporizer device 500. It is noted that all components of vaporizer device 500 shown in FIG. 5 are not required in each and every embodiment but the components of vaporizer device 500 are shown in FIG. 5 for purposes of complete illustration. For example, as shown in FIG. 7, susceptor element 558 and duct 594 may both extend through first opening 554 of reservoir 552.

As further shown in FIG. 7, first portion 550 of vaporizer device 500 includes reservoir 552, duct 594, susceptor element 558, and secondary reservoir 592. In some non-limiting embodiments, vaporizer device 500 may include aerosolizable substance 178 in reservoir 552. In some non-limiting embodiments, aerosolizable substance 178 may be transferred (e.g., may flow) through first opening 554 of reservoir 552 to secondary reservoir 592. For example, aerosolizable substance 178 may be transferred through first opening 554 of reservoir 552 to secondary reservoir 592 via susceptor element 558. In some non-limiting embodiments, aerosolizable substance 178 may be transferred from reservoir 552 to secondary reservoir 592 via susceptor element 558 when a pressure inside reservoir 552 is greater than or equal to a pressure outside of reservoir 552, and aerosolizable substance 178 may be included in secondary reservoir 592. In such an example, an amount of aerosolizable substance 178 may be transferred to secondary reservoir 592 to prevent the flow of air through second portion 598 of duct 594.

As further shown in FIG. 7, the amount of aerosolizable substance 178 included in secondary reservoir 592 may prevent the flow of air through second end portion 598 of duct 594 to first end portion 596 of duct 594. For example, the amount of aerosolizable substance 178 included in secondary reservoir 592 may prevent the flow of air through second end portion 598 of duct 594 to first end portion 596 of duct 594, thereby causing a vacuum to form in reservoir 552. In some non-limiting embodiments, when the vacuum forms in reservoir 552 the remaining portion of aerosolizable substance 178 may be retained in reservoir 552. In some non-limiting embodiments, first end portion 596 and/or second end portion 598 of duct 594 may include a tapered shape. In some non-limiting embodiments, susceptor element 558 may be positioned coaxially with regard to duct 594, where second end portion 598 of duct 594 comprises a tapered edge shape, and an end portion of susceptor element 558 comprises a tapered edge shape that corresponds to the tapered edge shape of second end portion 598 of duct 594.

In some non-limiting embodiments, susceptor element 558 may generate heat causing aerosolizable substance 178 included in susceptor element 558 to be aerosolized. For example, as susceptor element 558 generates heat and causes aerosolizable substance 178 to be aerosolized, and the aerosolizable substance 178 that is aerosolized may be carried away from susceptor element 558 via an air flow. In some non-limiting embodiments, the pressure inside reservoir 552 may decrease based on aerosolizable substance 178 to be aerosolized. In some non-limiting embodiments, aerosolizable substance 178 that is included in secondary reservoir 592 may be absorbed by susceptor element 558. For example, aerosolizable substance 178 that is included in secondary reservoir 592 may be absorbed by susceptor element 558 and carried away from susceptor element 558 via the air flow. In some non-limiting embodiments, as aerosolizable substance 178 is carried away from susceptor element 558 via the air flow, duct 594 may enable air to flow through first opening 554 of reservoir 552 based on the absorption of aerosolizable substance 178 included in secondary reservoir 592. For example, when an amount of aerosolizable substance 178 included in secondary reservoir 592 is equal to or less than a predetermined amount, air may flow from second end portion 598 through duct 594 to first end portion 596 of duct 594. In this example, the pressure inside reservoir 552 may increase.

Figure 8:
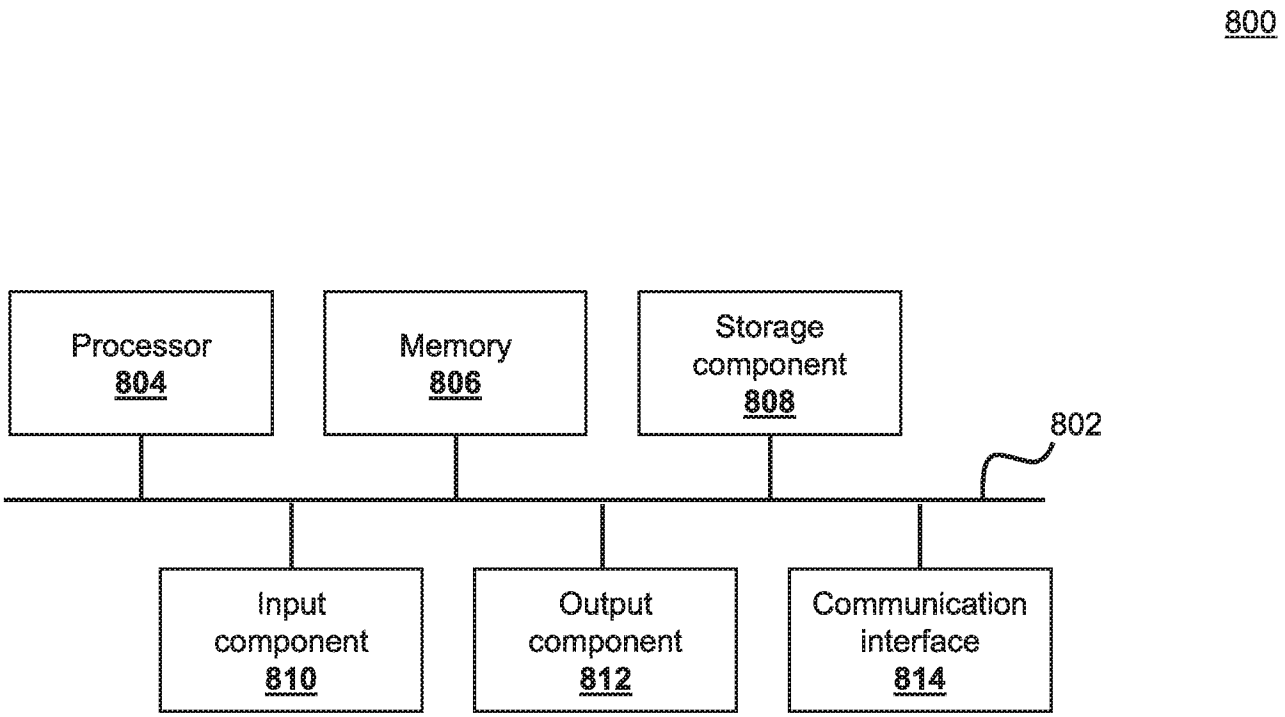
FIG. 8 is a diagram of a non-limiting embodiment of components of a vaporizer device.

Referring now to FIG. 8, FIG. 8 is a diagram of example components of a device 800. In some non-limiting embodiments, device 800 may correspond to control device 110. In some non-limiting embodiments, control device 110 includes at least one device 800 and/or at least one component of device 800. As shown in FIG. 8, device 800 includes bus 802, processor 804, memory 806, storage component 808, input component 810, output component 812, and communication interface 814.

Bus 802 includes a component that permits communication among the components of device 800. In some non-limiting embodiments, processor 804 is implemented in hardware, software (e.g., firmware), or a combination of hardware and software. For example, processor 804 includes a processor (e.g., a central processing unit (CPU), a graphics processing unit (GPU), an accelerated processing unit (APU), etc.), a microprocessor, a digital signal processor (DSP), and/or any processing component (e.g., a field-programmable gate array (FPGA), an application-specific integrated circuit (ASIC), etc.) that can be programmed to perform a function. Memory 806 includes random access memory (RAM), read only memory (ROM), and/or another type of dynamic or static storage device (e.g., flash memory, magnetic memory, optical memory, etc.) that stores information and/or instructions for use by processor 804.

In some non-limiting embodiments, storage component 808 stores information and/or software related to the operation and use of device 800. For example, storage component 808 includes a hard disk (e.g., a magnetic disk, an optical disk, a magneto-optic disk, a solid state disk, etc.), a compact disc (CD), a digital versatile disc (DVD), a floppy disk, a cartridge, a magnetic tape, a flash memory device (e.g., a flash drive), and/or another type of computer-readable medium, along with a corresponding drive.

In some non-limiting embodiments, input component 810 includes a component that permits device 800 to receive information, such as via user input (e.g., a touch screen display, a keyboard, a keypad, a mouse, a button, a switch, a microphone, etc.). Additionally or alternatively, input component 810 includes a sensor for sensing information (e.g., a temperature sensor, an accelerometer, a gyroscope, an actuator, a pressure sensor, etc.). Output component 812 includes a component that provides output information from device 800 (e.g., a display, a speaker, one or more light-emitting diodes (LEDs), etc.).

In some non-limiting embodiments, communication interface 814 includes a transceiver-like component (e.g., a transceiver, a separate receiver and transmitter, etc.) that enables device 800 to communicate with other devices, such as via a wired connection, a wireless connection, or a combination of wired and wireless connections. In some non-limiting embodiments, communication interface 814 permits device 800 to receive information from another device and/or provide information to another device. For example, communication interface 814 includes an Ethernet interface, an optical interface, a coaxial interface, an infrared interface, a radio frequency (RF) interface, a universal serial bus (USB) interface, a Wi-Fi® interface, a cellular network interface, a Bluetooth® interface, and/or the like.

In some non-limiting embodiments, device 800 performs one or more processes described herein. In some non-limiting embodiments, device 800 performs these processes based on processor 804 executing software instructions stored by a computer-readable medium, such as memory 806 and/or storage component 808. A computer-readable medium (e.g., a non-transitory computer-readable medium) is defined herein as a non-transitory memory device. A non-transitory memory device includes memory space located inside of a single physical storage device or memory space spread across multiple physical storage devices.

Software instructions are read into memory 806 and/or storage component 808 from another computer-readable medium or from another device via communication interface 814. In some non-limiting embodiments, when executed, software instructions stored in memory 806 and/or storage component 808 cause processor 804 to perform one or more processes described herein. Additionally or alternatively, hardwired circuitry is used in place of or in combination with software instructions to perform one or more processes described herein. Thus, embodiments described herein are not limited to any specific combination of hardware circuitry and software.

The number and arrangement of components shown in FIG. 8 are provided as an example. In some non-limiting embodiments, device 800 includes additional components, fewer components, different components, or differently arranged components than those shown in FIG. 8. Additionally or alternatively, a set of components (e.g., one or more components) of device 800 may perform one or more functions described as being performed by another set of components of device 800.

Although the disclosure has been described in detail for the purpose of illustration based on what is currently considered to be the most practical and preferred embodiments, it is to be understood that such detail is solely for that purpose and that the disclosure is not limited to the disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular form of "a," "an," and "the" include plural referents unless the context clearly dictates otherwise.

What is claimed is:

1. A vaporizer device comprising:

a reservoir configured to contain a vaporizable substance, the reservoir comprising a first opening and a second opening;

a susceptor element coupled to the reservoir, the susceptor element positioned within the first opening of the reservoir, the susceptor element configured to be in contact with the vaporizable substance; and a leakage prevention structure configured to transition the reservoir from a sealed state to an unsealed state; and wherein, when the reservoir is in the unsealed state, the leakage prevention structure enables air to flow through the second opening; and wherein, when the reservoir is in the sealed state, a vacuum is formed in the reservoir, and when the reservoir transitions from the sealed state to the unsealed state, the vacuum is released.

2. The vaporizer device of claim 1, further comprising:

a housing surrounding at least a portion of the reservoir, wherein the housing comprises a channel; and wherein air flowing through the channel of the housing causes the leakage prevention structure to transition to an open position thereby transitioning the reservoir from the sealed state to the unsealed state.

3. The vaporizer device of claim 1, wherein the leakage prevention structure comprises:

a valve coupled to the reservoir; and wherein when the reservoir is in the sealed state, the valve is in a closed position and, when in the closed position, the valve prevents the vaporizable substance from being transferred through the first opening of the reservoir; and wherein, when the reservoir is in the unsealed state, the valve is in an open position, and, when in the open position, the valve enables the vaporizable substance to be transferred through the first opening of the reservoir.

4. The vaporizer device of claim 3, wherein the valve comprises a flexible membrane.

5. The vaporizer device of claim 3, wherein the valve comprises a hydrophobic material.

6. The vaporizer device of claim 3, wherein an amount of the vaporizable substance transferred from the reservoir via the susceptor element to an area outside of the reservoir is determined at least in part based on a pressure inside the reservoir, the pressure inside the reservoir associated with a position of the valve coupled to the reservoir.

7. The vaporizer device of claim 3, further comprising:

a housing surrounding at least a portion of the reservoir, the housing comprising a third opening and a fourth opening, wherein a channel is defined within the housing that connects the third opening and the fourth opening; and wherein, when an amount of pressure inside the channel satisfies a pressure threshold associated with the unsealed state of the reservoir, the valve is configured to transition from the closed position to the open position based on the amount of pressure inside the channel.

8. The vaporizer device of claim 7, further comprising:

a mouthpiece positioned adjacent to the fourth opening; and wherein the valve is configured to transition from the closed position to the open position based on suction that is generated at the mouthpiece.

9. The vaporizer device of claim 7, wherein, when the amount of pressure inside the channel satisfies a pressure threshold associated with the sealed state of the reservoir, the valve is configured to transition from the open position to the closed position.

10. The vaporizer device of claim 7, wherein the housing and the at least a portion of the reservoir define the channel that connects the third opening and the fourth opening.

11. The vaporizer device of claim 7, wherein the housing surrounds at least a portion of the valve, and wherein the housing comprises a fifth opening that enables air to flow from an environment outside the housing into the channel of the housing.

12. The vaporizer device of claim 7, further comprising:

at least one processor programmed or configured to:

control the valve to transition between the open position and the closed position.

13. The vaporizer device of claim 12, further comprising:

an actuator coupled to the valve;

wherein the at least one processor is further programmed or configured to:

control the actuator to transition the valve between the open position and the closed position.

14. The vaporizer device of claim 13, further comprising:

a temperature sensor to obtain data associated with a temperature inside the channel of the housing;

wherein the at least one processor is further programmed or configured to:

control the actuator to transition the value between the open position and the closed position based on the data associated with the temperature inside the channel.

15. The vaporizer device of claim 1, wherein the leakage prevention structure comprises:

a secondary reservoir configured to receive the vaporizable substance from the susceptor element; and a duct comprising a first end portion, a second end portion, and a channel between the first end portion and the second end portion to allow air to flow within the channel, the first end portion of the duct positioned within the reservoir and the second end portion of the duct positioned within the secondary reservoir; and wherein, when an amount of vaporizable substance included in the secondary reservoir is at a predetermined amount, the reservoir is in the sealed state, and when the amount of vaporizable substance included in the secondary reservoir is not at the predetermined amount, the reservoir is in the unsealed state.

16. The vaporizer device of claim 15, wherein a portion of the duct extends through the second opening of the reservoir, and wherein the channel of the duct comprises the first opening of the reservoir.

17. The vaporizer device of claim 15, wherein a portion of the duct extends through the first opening of the reservoir; and wherein the susceptor element is positioned between the portion of the duct that extends through the first opening of the reservoir and the first opening of the reservoir.

18. The vaporizer device of claim 15, wherein the susceptor element is configured to receive thermal energy, wherein, the thermal energy causes an amount of the vaporizable substance associated with the susceptor element to be vaporized, and wherein, when vaporizing the vaporizable substance, the susceptor element absorbs the vaporizable substance from the secondary reservoir.

19. The vaporizer device of claim 15, wherein the susceptor element is positioned coaxially with regard to the duct.

20. The vaporizer device of claim 15, further comprising:

at least one processor programmed or configured to:

control the susceptor element to generate thermal energy to transition the reservoir between the sealed state and the unsealed state.

21. A vaporizer device comprising:

a reservoir configured to contain an aerosolizable substance, the reservoir comprising a first opening and a second opening;

a susceptor element coupled to the reservoir, the susceptor element coupled to the first opening of the reservoir, the susceptor element configured to be in contact with the aerosolizable substance; and a leakage prevention structure configured to transition the reservoir from a sealed state to an unsealed state;

wherein, when the reservoir is in the unsealed state, the leakage prevention structure enables air to flow through the second opening;

wherein, when the reservoir is in the sealed state, a vacuum is formed in the reservoir, and when the reservoir transitions from the sealed state to the unsealed state, the vacuum is released.

22. A vaporizer device comprising:

a reservoir configured to contain an aerosolizable substance, the reservoir comprising a first opening and a second opening;

a susceptor element coupled to the reservoir, the susceptor element coupled to the first opening of the reservoir, the susceptor element configured to be in contact with the aerosolizable substance; and a valve configured to transition the reservoir from a sealed state to an unsealed state;

wherein, when the reservoir is in the unsealed state, the valve enables air to flow through the second opening;

wherein, when the reservoir is in the sealed state, a vacuum is formed in the reservoir, and when the reservoir transitions from the sealed state to the unsealed state, the vacuum is released.

* * * * *